US008393472B2

(12) United States Patent
Hayduchok et al.

(10) Patent No.: US 8,393,472 B2
(45) Date of Patent: Mar. 12, 2013

(54) METHOD AND APPARATUS FOR AUTOMATED MAIL PROCESSING

(75) Inventors: George L. Hayduchok, Mount Holly, NJ (US); Robert R. DeWitt, Marlton, NJ (US)

(73) Assignee: Opex Corporation, Moorestown, NJ (US)

( * ) Notice: Subject to any disclaimer, the term of this patent is extended or adjusted under 35 U.S.C. 154(b) by 0 days.

(21) Appl. No.: 11/459,133

(22) Filed: Jul. 21, 2006

(65) Prior Publication Data

US 2007/0045930 A1 Mar. 1, 2007

Related U.S. Application Data

(60) Provisional application No. 60/701,965, filed on Jul. 22, 2005.

(51) Int. Cl.
*B07C 5/02* (2006.01)

(52) U.S. Cl. ..... 209/3.2; 209/552

(58) Field of Classification Search ..... 209/584, 209/900, 583; 271/2; 700/223–227
See application file for complete search history.

(56) References Cited

U.S. PATENT DOCUMENTS

| | | | | |
|---|---|---|---|---|
| 3,266,626 | A * | 8/1966 | Simjian | 209/545 |
| 4,863,037 | A | 9/1989 | Stevens et al. | |
| 4,921,388 | A | 5/1990 | Nelson | |
| 5,054,620 | A | 10/1991 | DeWitt et al. | |
| 5,054,700 | A | 10/1991 | DeWitt | |
| 5,061,146 | A | 10/1991 | Nelson | |
| 5,096,360 | A | 3/1992 | Nelson | |
| 5,115,918 | A | 5/1992 | DeWitt et al. | |
| 5,134,834 | A | 8/1992 | Hayduchok | |
| 5,143,225 | A * | 9/1992 | Rabindran et al. | 209/584 |
| 5,188,504 | A | 2/1993 | Nelson | |
| 5,240,116 | A | 8/1993 | Stevens et al. | |
| 5,293,431 | A | 3/1994 | Hayduchok et al. | |
| 5,310,062 | A | 5/1994 | Stevens et al. | |
| 5,397,003 | A | 3/1995 | Stevens et al. | |
| 5,460,273 | A | 10/1995 | Stevens et al. | |
| 5,464,099 | A | 11/1995 | Stevens et al. | |
| 5,675,671 | A | 10/1997 | Hayduchok et al. | |
| 5,842,577 | A | 12/1998 | Stevens et al. | |
| 6,151,422 | A | 11/2000 | Hayduchok et al. | |
| 6,311,846 | B1 * | 11/2001 | Hayduchok et al. | 209/3.3 |
| 6,547,078 | B1 | 4/2003 | Lile et al. | |
| 6,613,998 | B2 | 9/2003 | DeWitt et al. | |
| 2006/0124513 | A1 * | 6/2006 | McLaughlin et al. | 209/584 |

* cited by examiner

*Primary Examiner* — Joseph C Rodriguez
*Assistant Examiner* — Kalyanavenkateshware Kumar
(74) *Attorney, Agent, or Firm* — Stephen H. Eland; Dann, Dorfman, Herrell & Skillman

(57) ABSTRACT

An apparatus for the automated processing of bulk mail in a continuous and automatic procedure includes an operative combination of processing stations including an input station for receiving incoming mail in bulk fashion and for separating the pieces of mail for individual delivery to the remainder of the apparatus; a station for detecting irregularities in the contents of the envelopes, such as metal items, folded contents, or oversized items; a station for out-sorting envelopes rejected in accordance with determinations made at the detection station; a station for opening the envelopes, preferably along multiple edges; a station for removing the contents from the opened envelopes, for subsequent processing of the contents; and a series of stations for handling, imaging and orienting the contents for subsequent delivery to a plurality of output stackers.

26 Claims, 24 Drawing Sheets

METHOD AND APPARATUS FOR AUTOMATED MAIL PROCESSING

PRIORITY CLAIM

This application claims priority to U.S. Provisional Patent Application No. 60/701,965, filed Jul. 22, 2005, which is hereby incorporated by reference.

FIELD OF THE INVENTION

The present invention relates to a system and method for processing mail and, more specifically, to an apparatus and method for extracting, reordering, reorienting, imaging and sorting documents, and particularly remittance transactions in the form of an invoice and an accompanying check.

BACKGROUND OF THE INVENTION

Automated and semi-automated machines have been employed for processing documents such as bulk mail. Due to the large quantity of mail received by many companies, there has long been a need for efficient sorting of incoming mail. In this regard, document sorting has become particularly important in the area of remittance processing.

Utility companies, phone companies, and credit card companies routinely receive thousands of payment envelopes from their customers on a daily basis. Typically, a customer payment envelope contains an invoice stub and some type of customer payment, usually in the form of a bank check or money order. The contents of each envelope are generally referred to as a transaction, and may consist of one or more documents including one or more invoice and/or one or more check. The most common transaction consists of a single invoice stub and an accompanying payment check.

According to conventional methods of automated or semi-automated remittance processing, the documents, such as an invoice and an accompanying check, are processed by being extracted from the envelopes, placed in the proper sequence and orientation, and then stacked into groups or batches of documents. The extraction, sequencing and orienting of the invoices and checks has been effected both manually and by the use of automated or semi-automated equipment. Once arranged in stacks, the sequenced and oriented invoices and checks are then separated into groups of documents. This grouping, referred to as batching, is typically performed manually by inserting batch tickets into the stacks of documents to physically define selected batches of documents. The stacks of batched invoices and checks are then transferred to a separate remittance processing device and fed through the device multiple times to effect the necessary remittance processing. Because the stacks of invoices and checks are transferred to a separate remittance processing device after the documents have been extracted form the envelopes, errors may arise in determining which documents belong to which distinct transaction. Errors may arise in defining transactional boundaries because the documents have already been separated from the envelopes that physically and accurately define the boundaries for each transaction before processing is commenced on a remittance processing apparatus. Therefore, the remittance processing apparatus must attempt to determine the transitional boundaries based on the sequence of the documents that are fed through the apparatus. If the sequence of documents is not predetermined and precisely maintained, the transactional boundaries may be misplaced. For example, if more than one check is enclosed with a single invoice, it becomes difficult after the extraction has already been performed to ascertain whether the additional check should be included with the preceding or the following transactional documents. As a result, a check from one transaction may be processed erroneously with an invoice from another transaction.

Other problems may also arise whenever the invoices and the checks are not in proper uniform sequence or in the proper orientation. For example, the lack of proper sequencing and orientation may cause misreads or errors during a remittance processing run. If a check is being read instead of an invoice due to an improper sequence, the appropriate information will not appear at the proper location on the document during document imaging. Likewise, if a check is not in its proper orientation, an image of the back of the check may be misread as the front of the check. In accordance with the present invention, an apparatus and method are provided for extracting documents from envelopes, reordering and reorienting the documents, and imaging and storing data regarding the documents so that the association among the documents in the transactions is known during subsequent remittance processing and the proper images are acquired and stored for the documents.

SUMMARY OF THE INVENTION

In accordance with the present invention, an apparatus is provided for sorting a group of documents contained within envelopes into selected batches of documents. More specifically, the apparatus functions to sort a selected group of documents such as an invoice and an accompanying check contained within a remittance payment envelope into selected batches of invoices and checks. Appropriate image data is acquired and stored such as the MICR line of a check and the OCR line of an invoice.

To effect document processing, a document transport is provided for conveying the documents and the envelopes containing such documents along a selected path of movement. To input the envelopes onto the document transport, an envelope feeder is provided. The envelope feeder may be configured to hold a selected group of envelopes in position so that the envelopes may be fed in a serial manner onto the document transport. Unopened or partially unopened envelopes may be conveyed by the document transport through a series of testing stations to enable the detection of any nonconforming envelopes that fail to meet selected test criteria. For example, the envelopes may be conveyed through a thickness detector to determine whether any envelopes are too thick for further processing as well as a metal detector to determine whether any envelopes contain paper clips that could jam the apparatus. Any nonconforming envelopes may be outsorted from the apparatus. Envelopes that meet the selected test criteria are conveyed to the document transport along the selected path of movement for further processing.

An extractor is positioned along the path of movement for extracting the documents from the envelopes. Typically, the extractor may include a series of envelope edge cutters in order to cut open selected edges of each envelope to enable the document contents to be removed therefrom. If a proper extraction is effected, the envelope is discarded and the extracted documents are conveyed by the document transport along the selected path of movement. If the extraction is improper, the document may be reunited with the envelope and outsorted to a selected output area.

A system controller is provided for identifying the set of documents, such as an invoice and an accompanying check, extracted from each respective envelope as a single distinct transaction along the path of movement. The system controller also serves to monitor and maintain distinct transactional boundaries between successive transactions of documents. The system controller also controls image acquisition of selected documents and the storage of such information.

An orientation detector is positioned along the path of movement to determine the orientation of documents conveyed along the path of movement. Optionally, documents that have previously been extracted from envelopes, such as by manual extraction, may be fed directly to the orientation detector for processing. The orientation detector may include, for example, an optical detector device, such as a camera, for acquiring optical images of selected documents. In addition, the orientation detector may include a magnetic image reader for reading selected magnetic images or magnetic patterns from documents conveyed along the path of movement. A document orientor is provided for selectively changing the orientation of documents along the path of movement into a desired orientation along the path of movement. For example, the document orientor may include a document reverser for reversing the document from back to front along the path of movement, as well as a document inverter for inverting the document from top to bottom along the path of movement. As such, the document orientor functions to selectively change documents from an upside-down orientation into a right-side-up orientation and from a face-backward orientation to a face-forward orientation along the path of movement. The document orientor may also include a document reordering mechanism for changing the order of successive documents along the path of movement. More specifically, the document reordering mechanism functions to enable a trailing document to become a leading document and a leading document to then become the trailing document along the path of movement. In general, the document orientor functions to ensure that each type of document is positioned in the same orientation along the path of movement and that document pairs in each defined transaction are in a desired sequence such as invoice-check.

A separate document feeder may be positioned downstream from the envelope feeder for selectively feeding documents such as batch identification pieces, in the form of batch index cards into the path of movement. The document feeder may also function to feed additional transactional documents into the path of movement.

An image storage medium, in the form of a non-volatile storage medium, is provided for storing the acquired images of documents for subsequent remittance processing. A document sorter functions to sort documents of selected batches into selected output areas. A printer may also be employed along the path of movement for printing selected information on selected documents. For example, the printer may be utilized to print batch identification information such as a batch number, a transaction number and a document number on selected documents, such as checks or invoices.

A method in accordance with the present invention is also provided for sorting a group of documents contained within envelopes into selected batches of documents. Pursuant to the method, documents contained within the envelopes may initially be extracted from the envelopes so that the set of documents extracted from each individual envelope is identified and tracked as a single distinct transaction. The extracted documents are conveyed along a path of movement and the orientation of selected documents along the path of movement is then determined. The orientation of selected documents may be determined by acquiring optical and/or magnetic images of the documents. The documents are then selectively oriented along the path of movement into a desired orientation along the path of movement. Orienting documents into the desired orientation may included reversing documents from front to back or inverting or flipping documents from top to bottom along the path of movement. The sequence of selected documents may also be changed along the path of movement. The scanned image of documents are assigned into selected batches. The acquired images of the documents are stored and the documents are sorted into the respective batches. Batch identification pieces may be fed into the selected path of movement to identify selected batches into which selected documents may be grouped.

DESCRIPTION OF THE DRAWINGS

The foregoing summary as well as the following description will be better understood when read in conjunction with the figures in which.

DETAILED DESCRIPTION OF THE INVENTION

Figure 1:
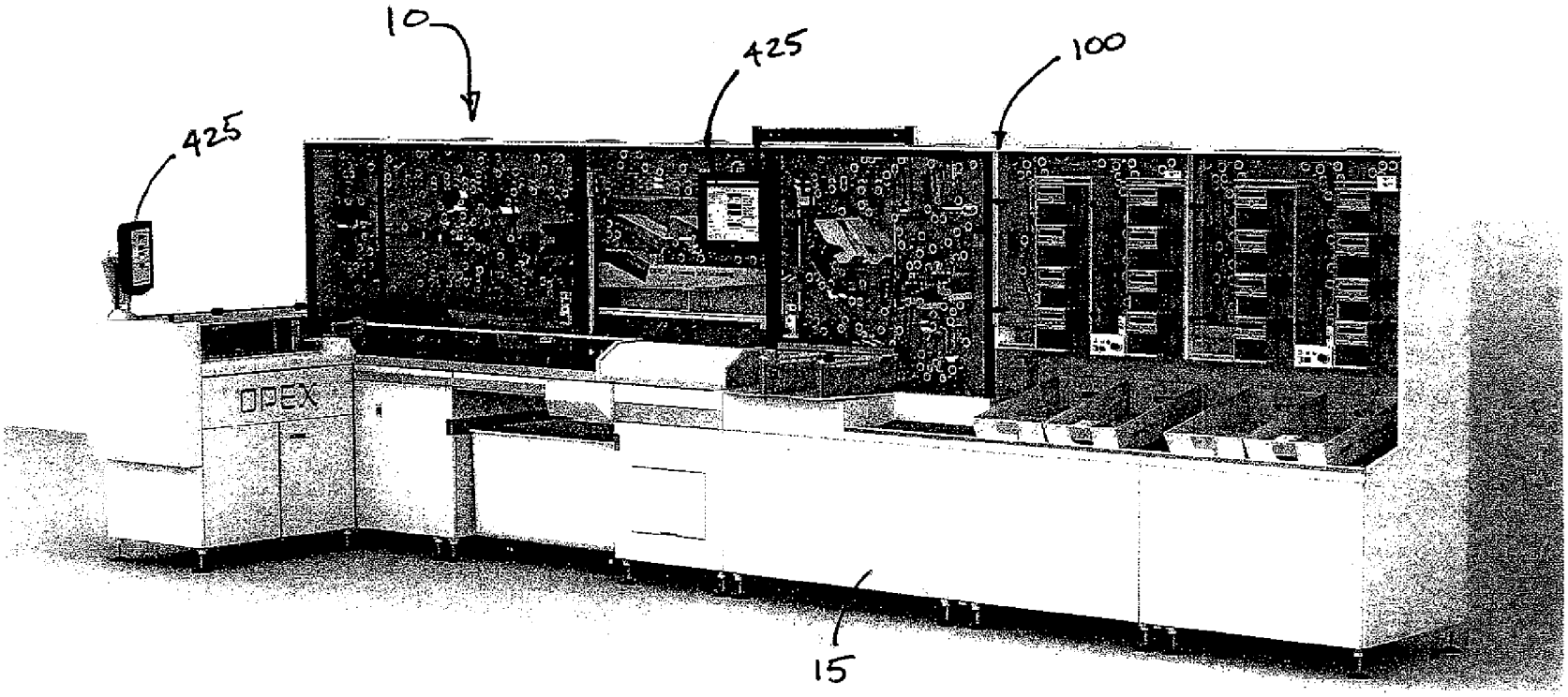
FIG. 1 is a perspective view of a mail processing apparatus.

Referring to the drawings in general, an apparatus 10 for automatic processing of documents contained within envelopes is illustrated. The apparatus 10 processes documents by extracting the documents from their envelopes, selectively reordering and reorienting the documents, acquiring and exporting image data for selected documents and sorting the documents into bins.

Figure 2:
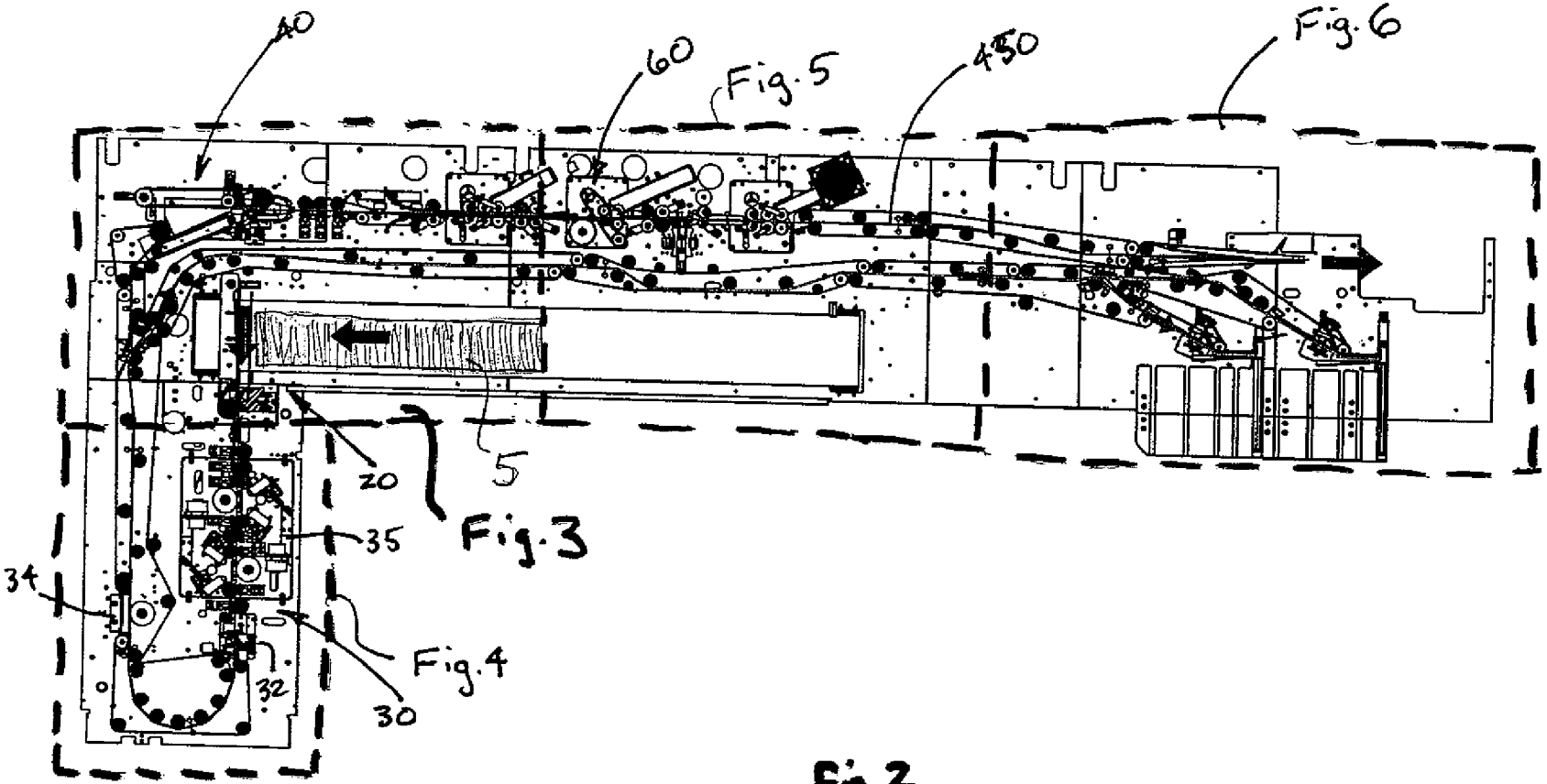
FIG. 2 is a fragmentary plan view of a section of the apparatus illustrated in FIG. 1.
Figure 11:
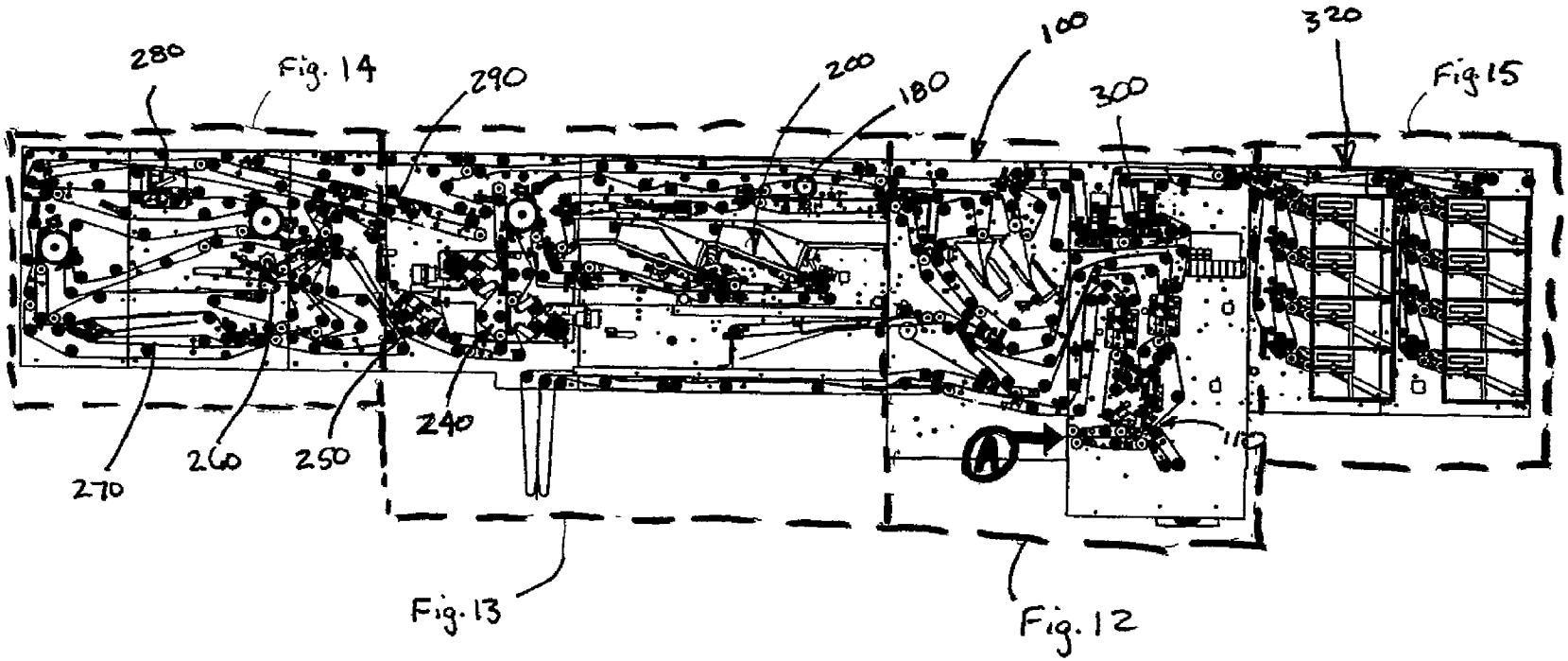
FIG. 11 is a side view of an upper portion of the apparatus illustrated in FIG. 1.

Referring to FIGS. 1, 2 and 11, a general overview of the flow of documents through the apparatus is provided. Initially, a stack of documents within envelopes 5 is serially fed into a system transport 450 by a feed station 20. The system transport 450 conveys the envelopes to an envelope qualifying station 30 that includes a thickness detector 32, a metal detector 34 and an optical envelope imager 35. The envelope qualifying station 30 examines each envelope to determine whether the envelope qualifies for extraction. Envelopes that are qualified for extraction are opened in a cutting area 60 and then conveyed to an extractor 110 to extract the transactional contents from the envelopes. A singulator 180 then separates the documents within the transactions and serially feeds the documents downstream.

After the documents are singulated, the documents are conveyed to an image acquisition module 240 that optically images each document to acquire image data for selected documents using at least one line scan camera. The image data is stored in a file for later use during remittance processing. The images are processed to extract information about each document, such as the OCR line that appears on invoices. The extracted information and the image of the document are used to create a document record for each document.

Next, the documents are scanned by a MICR detector 250 that scans each document to identify the presence and location of a MICR line to determine whether a document is a check or a non-check invoice, such as a payment stub.

After being processed by the image acquisition module 240 and the MICR detector 250, the order and orientation of the documents in a transaction are known. The documents then enter a re-orientation section that selectively re-orients the documents as necessary. Specifically, the documents are selectively manipulated by a reverser 260 and a twister 270 so that the documents in each transaction are in a predetermined orientation. Subsequently, the documents are selectively re-ordered by a re-ordering module 290 so that the documents in a transaction are in a predetermined order.

After the documents are properly oriented, the documents are conveyed to a MICR reader 280 that scans the documents to read the MICR line on the documents. Although the MICR reader 280 is operable to read a MICR line on various types of documents, the MICR reader is particularly suited to read the MICR line on payment documents, such as checks. The MICR data for a document is added to the data record for a document so that the information can be stored and then retrieved during subsequent processing.

The image data and date determined for the document are exported and stored to a non-volatile storage medium. The records for a group of transactions, referred to as a batch, are combined to form a batch file. In addition, the information determined for each document can be used to obtain further information regarding the documents and/or can be used to determine further processing for the documents. For instance, during subsequent processing different financial institutions have different requirements for clearing checks. Since the MICR line identifies the financial institution that the check is drawn against, this information can be used to either sort the checks according to financial institution or according to groups of financial institutions that accept certain types of transactions.

After scanning the MICR line, a printer module 300 prints information on the documents, such as the batch number, the transaction number, the document number, and the date on which the document was processed. From the printer module, the documents are conveyed to a stacker 320, which sorts the documents into a series of bins 322*a*-322*h*. The stacker 320 sorts the documents into groups referred to as batches. Each batch is assigned a control number, referred to as a batch number. For each batch, the stacker 320 sorts the invoices into one bin, and the checks into a separate bin. Alternatively, it may be desirable to stack the checks and invoices for a batch together into one bin so that the documents for each particular transaction are together in the same stack.

A system controller 430 monitors the flow of documents in response to signals received from the various components of the apparatus 10. In particular, the system controller 430 monitors the boundaries of each transaction as the documents are processed. Because each envelope defines the boundaries for each transaction, and the documents are initially contained within envelopes, the boundaries for each transaction are known. Once documents are extracted from an envelope, the system controller monitors the documents from each transaction to ensure that documents from one transaction do not become associated with the documents from a different transaction. For example, the system controller ensures that a check from envelope A does not become associated with an invoice from envelope B. This is referred to as maintaining transactional integrity. The system controller 430 ensures that transactional integrity is maintained through the entire process.

A personal computer allows an operator to interface with the system controller 430. An operations computer 410 is the primary interface with the system controller for controlling the operation of the apparatus. The operations computer 410 includes a touchscreen monitor 415 to display information regarding the processing of documents. In addition, the operations computer allows the operator to view document images acquired by the image acquisition module 240. A separate imaging computer may be provided to process the document image data and to control the operation of the image acquisition module. Alternatively, the imaging functions may be performed by the operations computer. In addition to, or instead of the touchscreen monitor, a keyboard may be provided to allow the operator to input various information necessary to process a group of documents, such as the type of transactions to be processed. In addition, an optional envelope imaging computer 420 having a touchscreen display 425 allows the operator to view envelope images and interface with an envelope imaging computer that controls the acquisition of envelope images and processes the image data acquired in the envelope image acquisition module 35.

In the present instance, to minimize the floor space of the apparatus, the apparatus 10 is separated into a generally horizontal lower section 15 and a generally vertical upper section 100, as shown in FIG. 1. The lower section includes a feed station 20 that serially feeds envelopes from a stack of mail and continues through to a cutting station 60 that cuts open the envelopes. An overview of the lower section 15 of the paper path is illustrated in FIG. 2, and enlarged views of the lower section are illustrated in FIGS. 3-6.

From the lower section 15, the paper path turns upwardly and enters the upper section 100, which includes sections starting with an extractor 110 that separates the contents from the opened envelopes, and continues through to a stacker 320 that stacks the extracted documents into a plurality of output bins from the extractor 110 through to the stacker 320. An overview of the upper section 100 is illustrated in FIG. 11, and enlarged views of the upper section are illustrated in FIGS. 12-15.

The apparatus and methods of operation will now be described in greater details.

Qualifying Envelopes for Extraction

Figure 3:
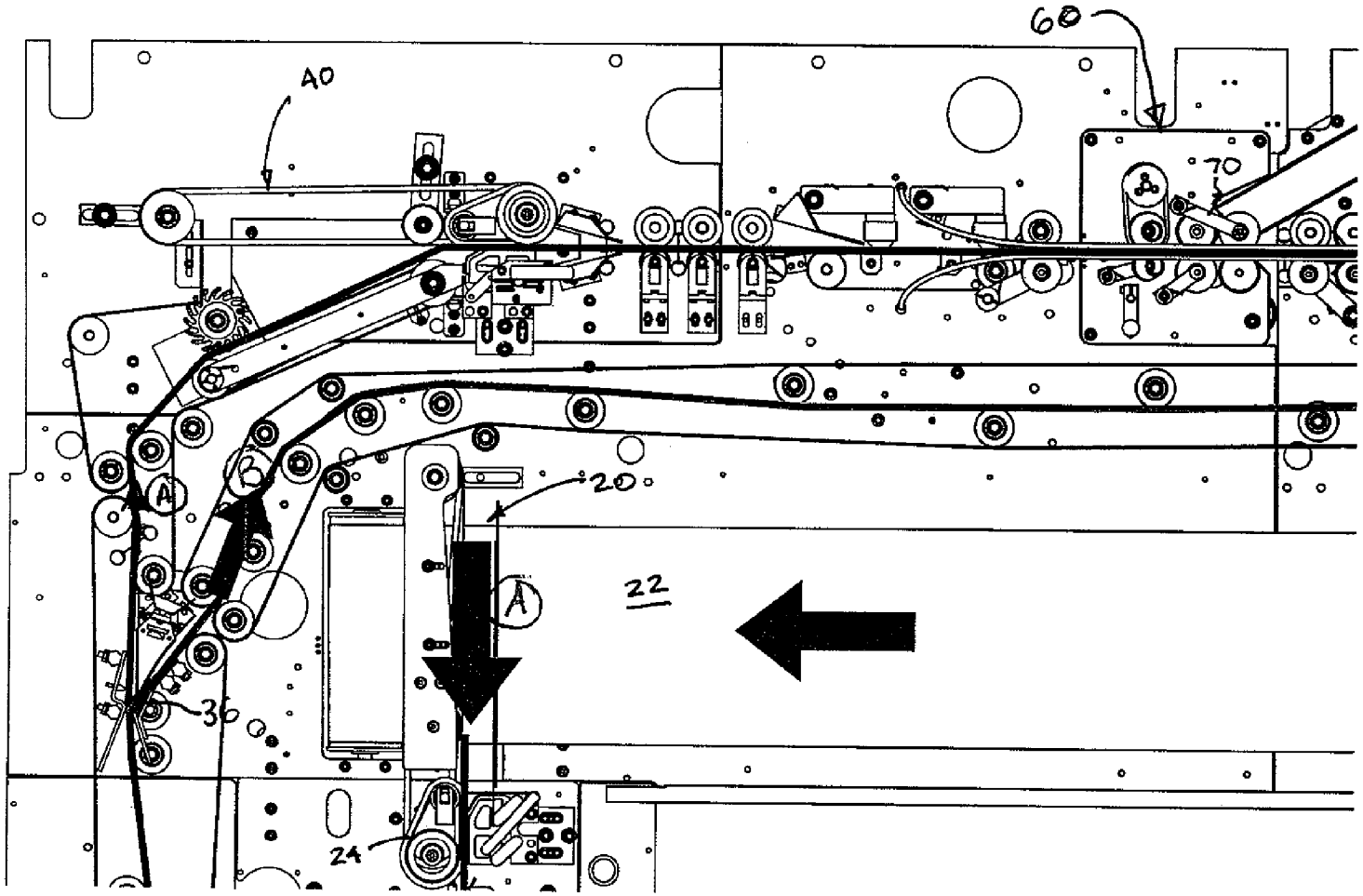
FIG. 3 is an enlarged fragmentary plan view of a portion of the apparatus illustrated in FIG. 2 bounded by the area identified as FIG. 3.
Figure 4:
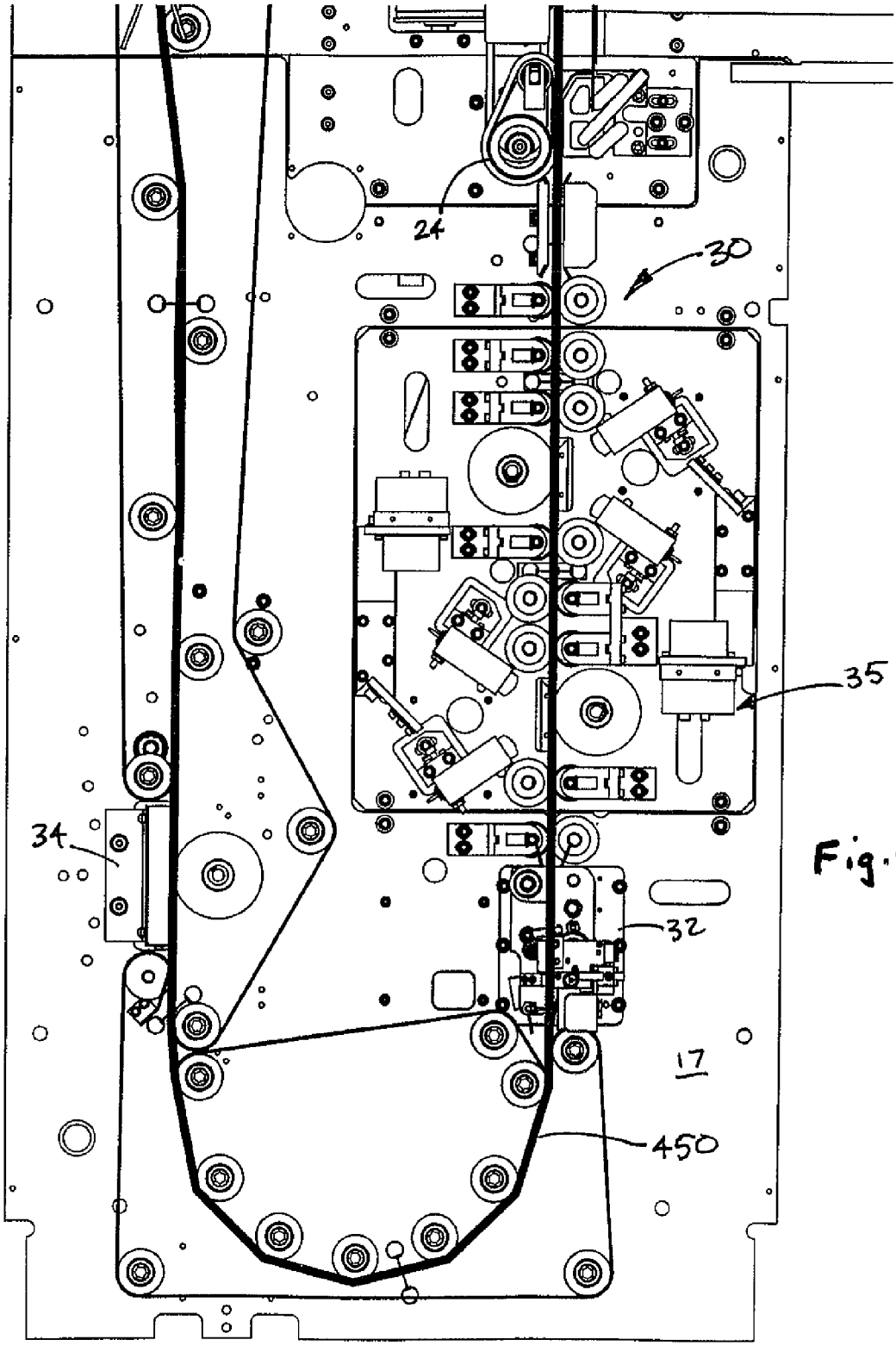
FIG. 4 is an enlarged fragmentary plan view of a portion of the apparatus illustrated in FIG. 2 bounded by the area identified as FIG. 4.
Figure 5:
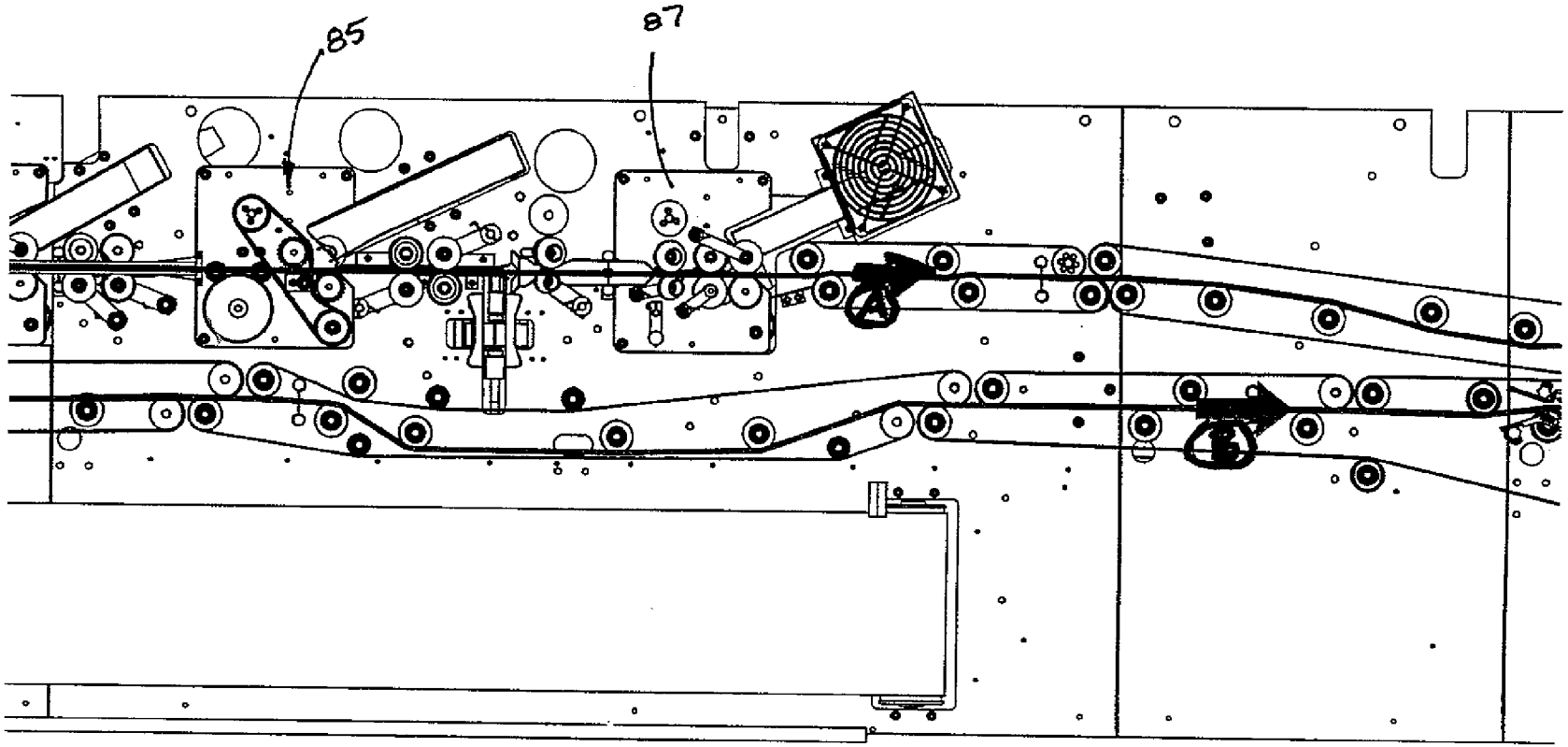
FIG. 5 is an enlarged fragmentary plan view of a portion of the apparatus illustrated in FIG. 2 bounded by the area identified as FIG. 5.
Figure 6:
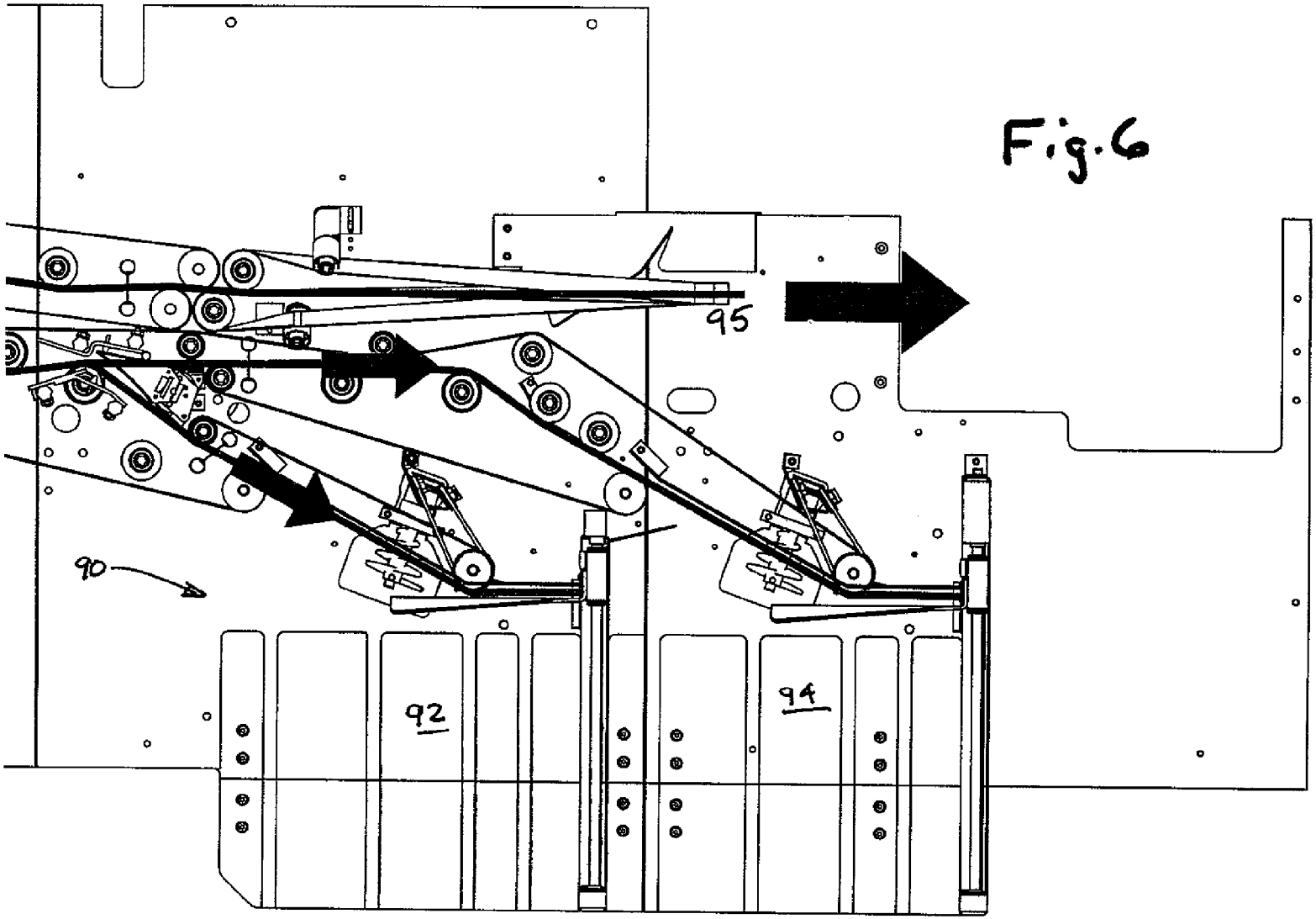
FIG. 6 is an enlarged fragmentary plan view of a portion of the apparatus illustrated in FIG. 2 bounded by the area identified as FIG. 6.

Referring now to FIGS. 2, 3 and 4, a stack of envelopes is placed onto a feed conveyor 22 adjacent the envelope feeder 24. The feed conveyor 22 is an elongated generally horizontal conveyor that is configured to received a horizontal stack of envelopes. The feed conveyor 22 conveys the stack toward the envelope feeder 24, which serially feeds the envelopes from the stack of mail on the feed conveyor and into the system transport 450 along the path designated A. The system transport conveys the envelopes to an envelope qualifying station 30 that includes a series of detectors for examining each envelope to determine if the envelope meets certain criteria for being extracted. If an envelope meets the criteria for extraction, the envelope is directed to the cutting area 60 and the extractor 110. Otherwise the envelope is directed to an outsort area 90 having bins 92, 94.

The first extraction qualifying detector is a thickness detector 32. If the thickness of an envelope does not fall within a predetermined range, the envelope is electronically tagged by the system controller 430 and outsorted prior to extraction. For example, the basic mode of operation for the apparatus 10 is processing singles, which are transactions that consist of only one check and one invoice. Envelopes that contain only one document, such as a check without an invoice, will have a thickness that is less than the allowable range. Such envelopes are not qualified for extraction. In the same way, envelopes that contain more than two documents or folded documents will have a thickness that is greater than an allowable range, and therefore are not qualified for extraction. Envelopes that do not qualify for extraction are electronically tagged and outsorted prior to extraction so that the outsorted envelopes can be processed separately from the envelopes containing singles. In addition, the thickness indicator 32 does not qualify envelopes containing paper clips or returned credit cards because the envelopes typically have a thickness that is greater than the allowable range. Therefore, envelopes containing returned credit cards or paper clips, which generally require special handling, are outsorted prior to extraction.

The envelopes are next qualified by a metal detector 34. The metal detector detects the presence of ferrous and non-ferrous metallic objects such as staples and paper clips. If the metal detector 34 detects the presence of a metallic object within an envelope, the envelope is not qualified for extraction and the system controller 430 electronically tags the envelopes so that the envelope is outsorted prior to extraction.

An envelope image acquisition module 35 including at least one line scan camera may also be included to qualify the envelopes prior to extraction. In the present embodiment, the envelope image acquisition module is located along the system transport 450 between the envelope feeder 22 and the thickness detector 32. The envelope image acquisition module 35 scans the envelopes or selected portions to acquire image data for each envelope. The image data for the envelopes may be processed to determine whether selected information or markings are present. For instance, a customer response box may be located on the back of an envelope. The envelope image acquisition module 35 scans the customer response box to determine whether the customer has indicated a response by placing a mark in the response box. In addition to scanning for marks, the envelope image acquisition module 35 can be used to determine the presence of particular information on an envelope, such as a change of address indication on the envelope and a POSTNET bar code. The envelope image acquisition module 35 can further be used to detect whether an envelope and its contents are damaged. Still further, the envelope image acquisition module 35 may be used to detect the date of mailing identified on the envelope.

After an envelope is imaged, the envelope image data may be exported and stored on a non-volatile storage medium. Additionally, the envelope image data may be added to or associated with the data record(s) for the contents of the envelope that are subsequently created. The other data determined from an analysis of the envelope image data (e.g. date of mailing) is also stored so that it can later be added to or associated with the data record(s) for the contents.

If the envelope and its contents are damaged, or if selected information or a mark is detected, the envelope may be electronically tagged and outsorted prior to extraction. Alternatively, if selected information or a mark is detected and the envelope is not damaged, the envelope and its contents may be processed and the system controller 430 may electronically tag the envelope indicating that selected information was present on the envelope or that a particular mark was present on the envelope. Later, the data regarding the information or mark appearing on the envelope can be combined with data regarding the image of the documents in the envelope, as will be further discussed below. The optical envelope imager may also include a second camera so that both sides of each envelope can be scanned to qualify the envelopes.

From the metal detector 34, the system transport 450 conveys the documents to a gate 36 that is operable between two positions. Envelopes that were not qualified for extraction because they do not meet certain criteria are directed down an outsort path designated B in FIG. 3 to the outsort area 90. For example, if the thickness detector 32 detects an envelope that has a thickness that is not within a pre-determined range, the system controller does not qualify the envelope for extraction, and the envelope is directed to outsort path B. Envelopes that are qualified for extraction are directed down the path designated A toward a buffer feeder station 40 adjacent the cutting area 60.

Buffer Feeder Station

As discussed above, the envelope qualifying station 30 selectively qualifies envelopes for further processing. Envelopes that do not qualify for extraction are outsorted to the envelope outsort area 90. These outsorted envelopes create gaps in the flow of envelopes along the system transport. In turn, the gaps in the flow of envelopes lead to gaps in the flow of documents, which reduce the effective throughput of the apparatus. The buffer feeder station 40 is configured to reduce these gaps in the flow of documents.

Figure 7:
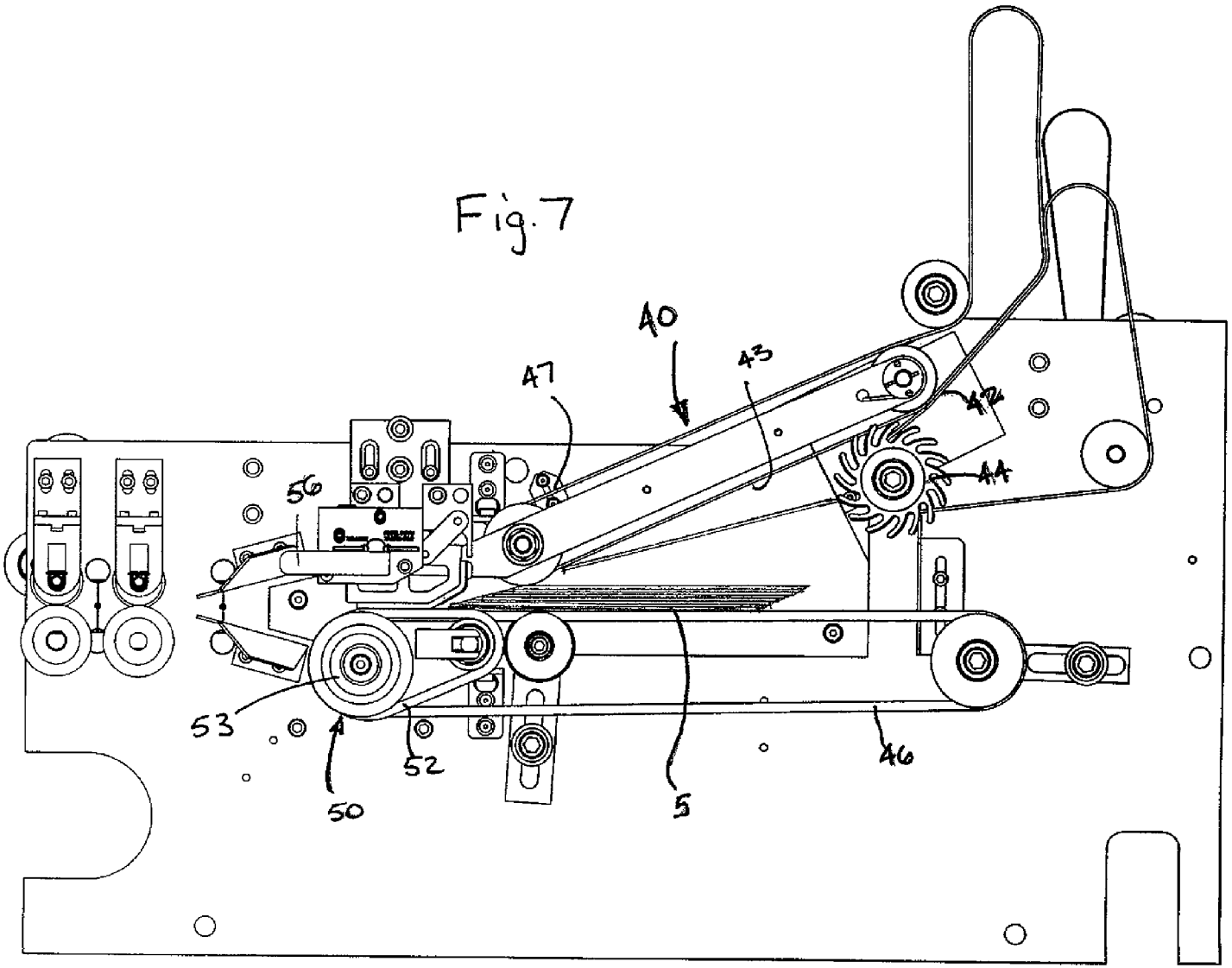
FIG. 7 is an enlarged plan view of a buffer feeder station of the portion of the apparatus illustrated in FIG. 3.
Figure 8:
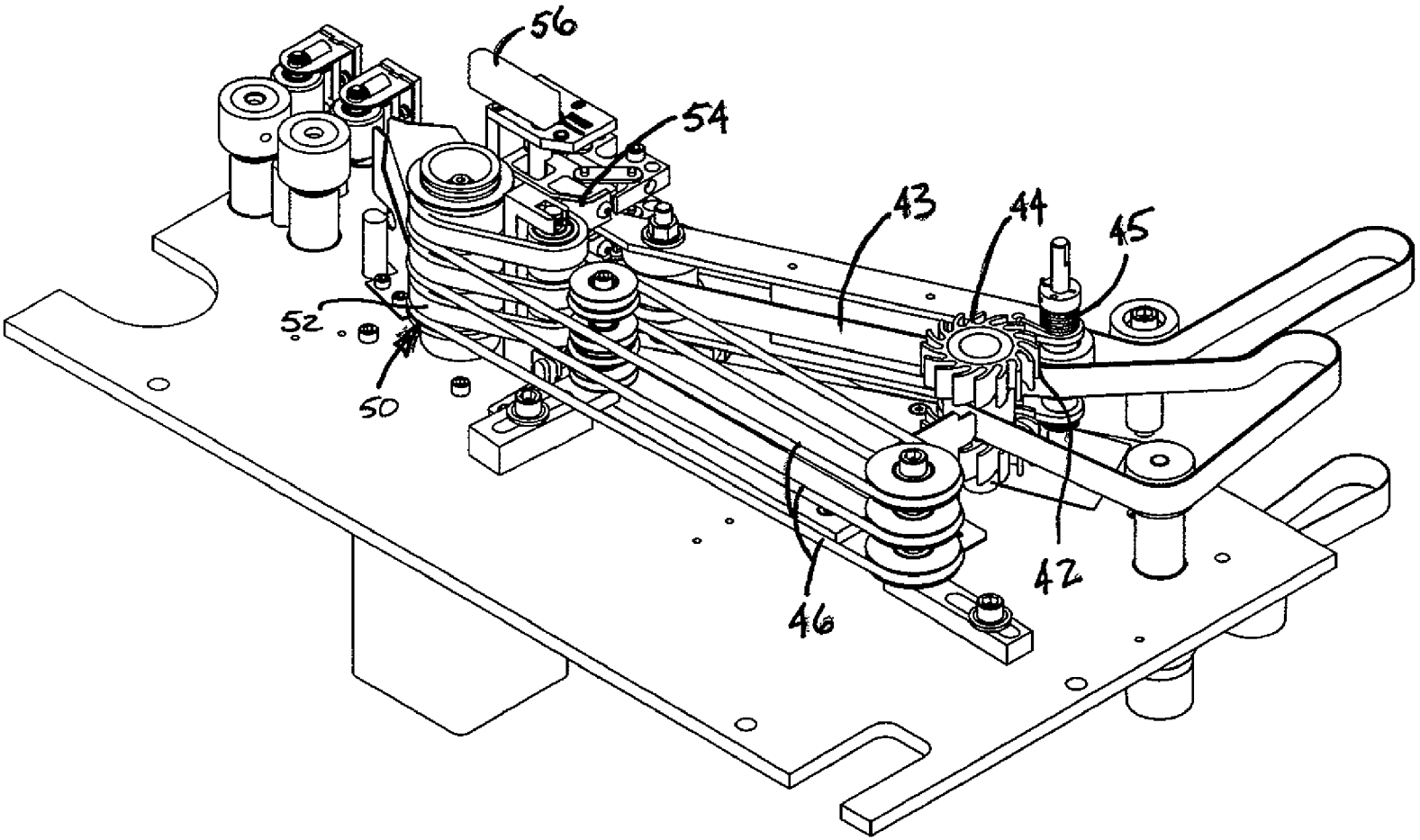
FIG. 8 is a perspective view of the buffer feeder station illustrated in FIG. 7.

The buffer feeder station 40 is positioned along the system transport 450 between the envelope qualifying station 20 and the cutting area 60. Referring to FIGS. 7-8, the buffer feeder 40 comprises a discharge nip 42 for discharging envelopes from the belts of the system transport. From the discharge nip, the envelopes are displaced toward a plurality of pre-feed belts 46. As discussed further below, after the envelopes are discharged from the discharge nip 42, the envelopes are not nipped or positively entrained until the envelopes enter a feeder 50. Instead, the envelopes are urged toward an area where the envelopes can accumulate in a stack.

A flapper wheel 44 is positioned adjacent the discharge nip 42 opposing an entry belt 43. The flapper wheel 44 comprises a plurality of radially extending fingers spaced about the circumference of the wheel. The fingers are resiliently flexible as discussed further below. The buffer feeder 40 may comprise a single flapper wheel, however, as shown in FIG. 8, in the present embodiment, the buffer feeder comprises a pair of flapper wheel disposed on a single axle. The flappers wheels 44 are vertically spaced apart so that the upper flapper wheel is positioned above the entry belt 43 and the lower flapper wheel is positioned below the entry belt.

The entry belt 43 is oriented transverse the array of pre-feed belts, comprising a plurality of vertically spaced apart belts 46, as shown in FIG. 8. The pre-feed belts 46 operate to urge the envelopes toward the feeder 50.

As shown in FIGS. 7-8, the feeder 50 comprises a plurality of vertically spaced apart feed belts 52 entrained around a drive pulley 53 and an idler pulley. In addition, the pre-feed belts 46 are also entrained about the feeder drive pulley 53, so that the feeder drive pulley drives both the feed belts 52 and the pre-feed belts 46.

The buffer feeder 40 is configured to reduce or eliminate double feeds, which refers to the problem of simultaneously feeding more than one envelope at a time. In particular, the buffer feeder 40 includes a retard assembly 54 confronting the feeder 50. The retard assembly 40 operates to engage and hold back trailing envelopes while the feeder 50 feeds the lead envelope away from the stack of envelopes that accumulate in the buffer feeder. If two envelopes are simultaneously fed into the document path between the retard assembly 54 and the feeder 50, the trailing envelope engages the retard assembly 54 and the leading envelope engages the feeder 50.

The retard assembly 40 includes an outer surface formed of a medium-friction material, and the feed belts 52 of the feeder 50 are formed of a high-friction material. Accordingly, the friction between the retard assembly 54 and the trailing envelope, and the friction between the feeder 50 and the leading envelope are both greater than the friction between the two envelopes. In this way, when two envelopes are simultaneously fed between the retard assembly 54 and the feeder 50, the feeder feeds the leading envelope, while the friction between the retard assembly 54 and the trailing envelope impedes forward displacement of the trailing envelope.

A lever 56 on the retard 54 is operable to displace the retard between an engaged position in which the retard is displaced toward the feeder 52 and a disengaged position in which the retard is displaced away from the feeder to create a gap between the retard and the feeder.

As shown in FIG. 7, since the entry belt 43 is transverse the pre-feed belts 46, an angled gap is formed between the entry belt and the pre-feed belts. This gap provides an accumulation area for receiving and maintaining a plurality of envelopes. The feeder 50 serially feeds the envelopes from the stack of envelopes that accumulate in the accumulation area during operation.

The details of operation of the buffer feeder will now be described. The system transport 450 from the envelope feeder 24 to the buffer feeder 40 is operable at a higher speed than the transport speed from the buffer feeder to the extraction station 110. Therefore, the envelope feeder 24 and system transport 450 are operable to feed envelopes to the buffer feeder at a rate that is higher than the rate at which the buffer feeder can feed envelopes into the system transport downstream from the buffer feeder. Since envelopes may be fed to the buffer feeder 40 at a higher rate than the buffer feeder can feed the envelopes, a plurality of envelopes, such as 5-10 envelopes, may accumulate to form a stack of envelopes. By feeding from a stack of envelopes in the buffer feeder, the buffer feeder can reduce or eliminate the gaps in the flow of envelopes caused by outsorting envelopes.

As an envelope enters the buffer feeder 40 at the entry nip, the entry belt 43 urges the envelope forwardly, angled toward the pre-feed belts 46. As the trailing edge of the envelop passes the flapper wheel 44, the resilient fingers on the flapper wheel engage the trailing edge and deform in a clockwise direction (from the perspective of FIG. 7). As the trailing edge of the envelope passes by the flapper wheel 44, the fingers that engaging the envelope resiliently rebound in a counter-clockwise direction and whip the trailing edge of the envelope laterally toward the pre-feed belts. In this way, the flapper wheel 44 urges the trailing edge of the envelope toward an orientation generally parallel to the pre-feed belts 46. As a stack of envelopes accumulates in the buffer feeder 40, the pre-feed belts urge the envelopes in the stack forwardly toward the feeder 52.

If the stack of envelopes in the buffer feeder exceeds a certain thickness, the envelopes will tend to jam. Accordingly, preferably the system controller controls the operation of the main envelope feeder 24 and/or the speed of the system transport through the envelope qualification station 20 to maintain the thickness of the stack of envelopes in the buffer feeder between an upper limit and a lower limit. If a sensor indicates that the thickness of the stack falls below a predetermined limit, the system controller responds to the signal from the sensor, and increases the feed rate of the main envelope feeder 24 and/or increases the speed of the transport through the envelope qualification station 20. Similarly, if the sensor indicates that the thickness of the stack exceeds a predetermined limit, the system controller responds to the signal from the sensor and reduces the feed rate of the main envelope feeder 24 and/or decreases the speed of the transport through the envelope qualification station 20.

In the present embodiment, a sensor 47 detects the thickness of the stack of envelopes in the accumulation area to control the feeding of envelopes to the buffer feeder 40. More specifically, in the present instance, the entry belt 43 is entrained about a pivotable arm. A biasing element in the form of a torsion spring 45 biases the arm toward the stack of envelopes in the buffer feeder so that the pivoting arm engages the top envelope in the stack. The sensor 47 is operably connected with the arm to detect the position of the arm. As the stack of envelopes in the buffer feeder reduces, the pivotable arm pivots in a counter-clockwise direction (from the perspective of FIG. 7). If the arm pivots clockwise beyond a predetermined limit, the sensor 47 transmits a signal to the system controller, which in turn controls the feeding of the envelopes to increase the feed rate of envelopes to the buffer feeder.

As described above, the buffer feeder 40 in configured to receive a stack of envelopes from the envelope qualifying station and serially feed the envelopes to the cutting station. Therefore, an outsorted envelope does not necessarily create a gap in the flow of envelopes. Instead, the feed rate of envelopes being fed to the buffer feeder 40 is increased as necessary to ensure that there is a sufficient number of envelopes in the buffer feeder to continuously feed envelopes. In this way, the gaps in the flow of envelopes to the cutting area 60 can be reduced or eliminated.

Although it may be desirable for the buffer feeder 40 to feed envelopes as set forth above, in certain situations it may be desirable to simply feed the envelopes at a constant rate, without accumulating a stack of envelopes in the buffer feeder. Accordingly, the lever 56 on the retard 54 may be displaced to the disengaged position so that the retard is displaced away from the feeder 50. In addition, the system controller controls the feeding of the envelopes so that the buffer feeder is able to feed each envelop as it enters the buffer feeder without accumulating the documents. Such a mode is referred to as the straight through mode From the buffer feeder 40, the envelopes are conveyed to the cutting station.

Cutting Station

In the cutting station 60, the leading edge, top edge and bottom edge of each envelope are cut so that the faces of each envelope are joined only along the trailing edge. The details of the cutting station 60 are illustrated in FIGS. 3,5,9 and 10. The cutting station 60 includes three cutter assemblies: a first cutter assembly 70 that cuts the leading edge of each envelope; a second cutter assembly 85 that cuts the top edge of each envelope; and a third cutter assembly 87 that cuts the bottom edge of each envelope.

When an envelope enters the cutting station 60, the envelope is oriented so that the bottom edge of the envelope is down, and is generally parallel to the base plate of the cutting station. The system transport 450 displaces the envelope forwardly into engagement with a kicker 65 that pivots the envelope so that the leading edge of the envelope is down, and is generally parallel to the base plate 62. The kicker 65 engages the leading edge of the envelope below the midpoint of the height of the envelope. In this way, as the system transport 15 displaces the envelope forwardly, the envelope pivots about the kicker 65. A pair of opposing upper guide rails 63 guide the envelope and prevent the envelope from falling over as it is conveyed along its short leading edge.

The kicker 65 comprises a generally U-shaped pivoting shoe. More specifically, the kicker comprises a base 67 and a pair of spaced apart walls 66 extending upwardly from the base. A biasing element 68 in the form of a torsion spring biases the kicker toward the position illustrated in FIG. 9.

As the system transport conveys an envelope toward the kicker 65, the leading edge of the envelope, adjacent the bottom edge of the envelope, engages the base 67 of the of the kicker. The kicker pivots about a pivot point, so that as the system transport drives the envelope forward, the kicker pivots counter-clockwise (from the perspective of FIG. 10) to the position shown in phantom. In turn, the envelope also pivots counter-clockwise (from the perspective of FIG. 10) so that the leading edge of the envelope is pivoted against the support rail. In FIG. 10, the envelope is shown in phantom (not to scale) after being pivoted. Once the envelope is displaced forwardly out of engagement with the kicker 65, the biasing element returns the kicker to the position shown in FIG. 9 so that the kicker is ready to engage the next envelope.

After the kicker 65 pivots the envelope, the first cutter assembly 70 cuts the leading edge of the envelope. Upon passing through the first cutter assembly 70, the envelope engages a second kicker that is configured substantially similarly to the first kicker 65. The second kicker reverse pivots the envelope so that the envelope is once again conveyed with its bottom edge down. The second cutter assembly 85 then cuts the top edge of the envelope. The system transport then conveys the envelope to the third cutter assembly 87, which cuts the bottom edge of the envelope while the envelope is being conveyed with its bottom edge down.

Figure 9:
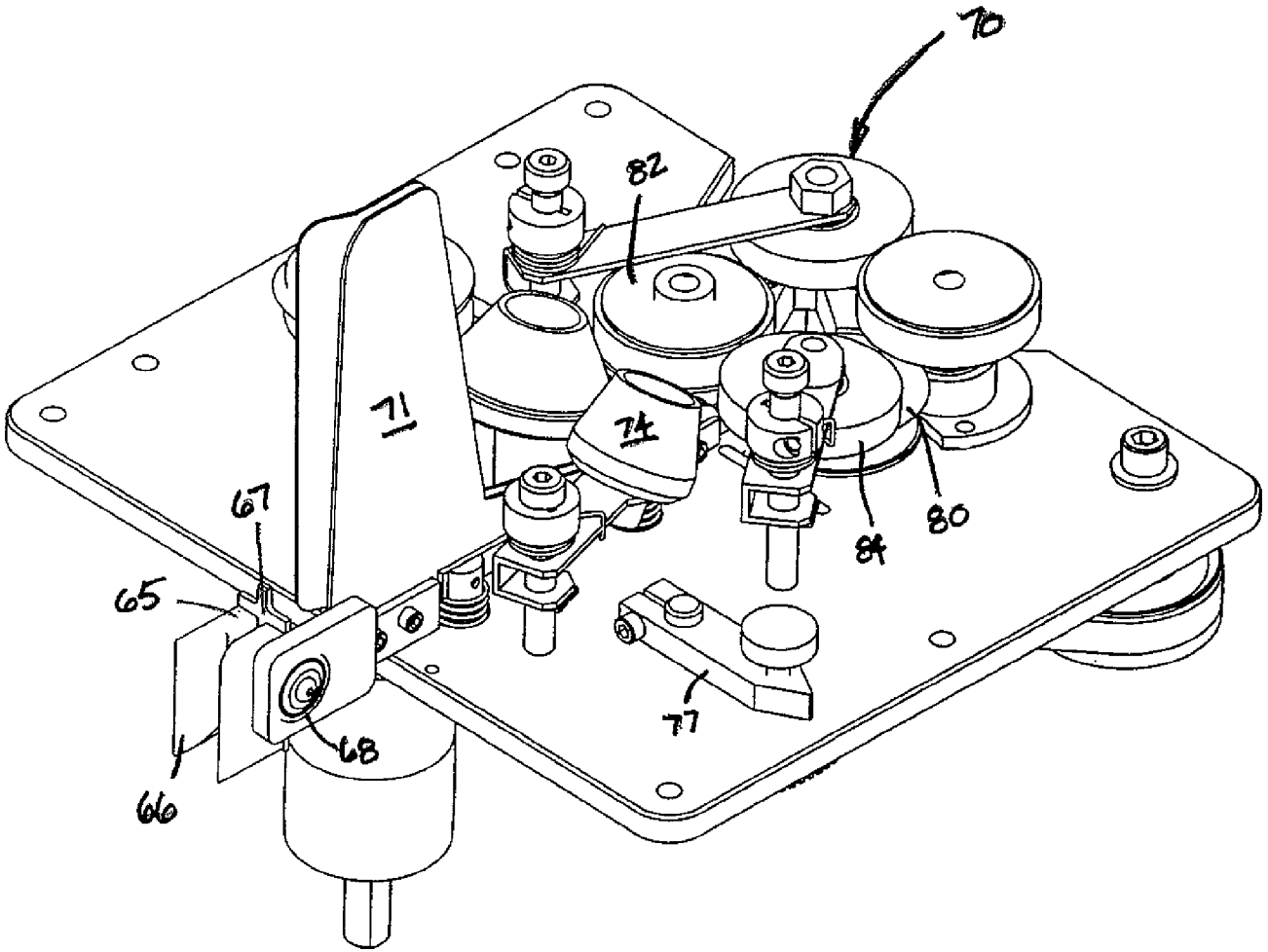
FIG. 9 is an enlarged perspective view of a cutter assembly of the portion of the apparatus illustrated in FIG. 3.
Figure 10:
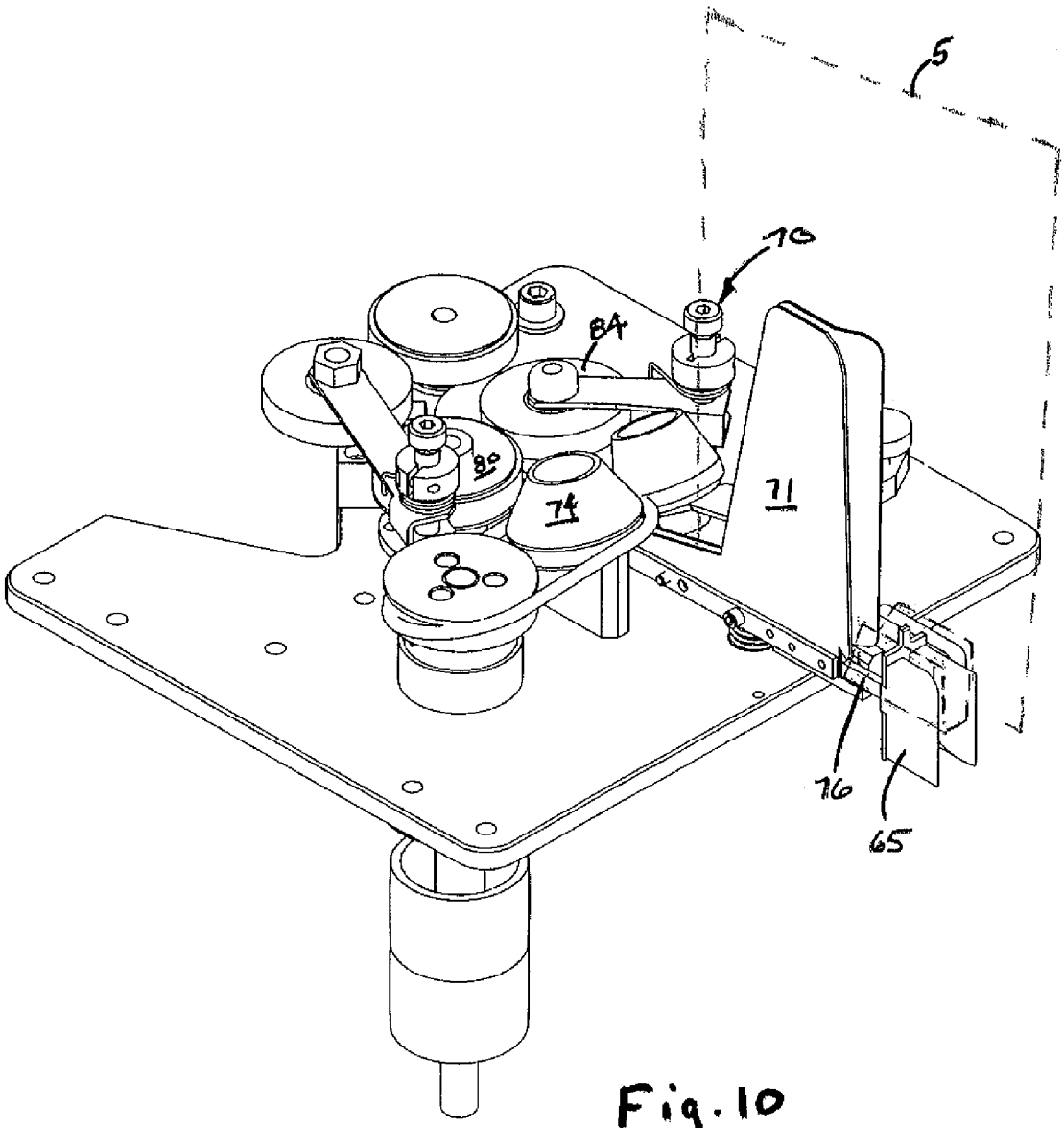
FIG. 10 is a second enlarged perspective view of the cutter assembly illustrated in FIG. 9.

Referring to FIGS. 9-10, the details of the first cutter assembly 70 are illustrated. The first cutter assembly 70 utilizes two opposing rotary knives or cutting blades 80 to slice off the lead edge of the envelope. As the envelope enters the first cutter 70, a pair of laterally spaced mail guides 71 form an entrance slot for guiding and supporting the envelope as it is conveyed with its leading edge down. The mail guides are connected to and extend upwardly from a support rail 76 that is substantially horizontal. A justifier 74 in the form of angled opposing rollers, justifies the envelope downwardly so that the leading edge contacts the support rail 76. In this way, the height of the leading edge for all of the envelopes is consistent as the envelopes are conveyed to the rotary knives 80. A driver roller 82 and an opposing idler roller 84 adjacent the justifier 74 form a nip for receiving envelopes from the justifier. The idler roller 84 is pivotable and is biased toward the drive roller. The rotary knives 80 are driven by drive roller 82 and form a rotary shear in line with the envelope path and are positioned a small distance above the support rail 76. Accordingly, as the envelope is conveyed between the drive roller and the idler roller 84, the knives 80 slice through the leading edge of the envelope, severing a portion of the leading edge.

The first cutter 70 includes a depth of cut controller 77 for varying the width of the portion of the envelope that the knives 80 severs. The depth of cut can be varied by either vertically adjusting the knives 80 or by vertically adjusting the support rail 76 that sets the height of the bottom edge of the envelope as the envelope is conveyed past the knives 80. In the present instance, the depth of cut is varied by adjusting the vertical position of the support rail.

From the first cutter assembly 70 the envelope is conveyed to the second cutter assembly 85 that opens the top edge of the envelope. As described previously, between the first and second cutters, the envelope engages a second kicker that is configured substantially similarly to the kicker described above. The second kicker reverse pivots the envelope so that the envelope is generally horizontally disposed with the top edge up and the bottom edge down, generally parallel to the document path. The second and third cutter assemblies 85, 87 are configured substantially similarly to the first cutter assembly described above. However, the second cutter assembly 85 is oriented upside down relative to the first cutter assembly so that the cutter assembly is generally disposed above the transport path, to cut the top edge of the envelope.

After an envelope 5 passes through the cutting station 60, three edges of the envelope are severed: the leading edge and the top and bottom edges. The trailing edge of the envelope connects the front and rear faces of the envelope, with the contents between the two faces. To finish removing the contents from the envelope, the edge-severed envelopes are conveyed to the extractor 110, which is in the upper section 100 of the apparatus 10. Therefore, after leaving the cutting station 60, the envelopes are conveyed through a turnabout 95 that twists the envelopes and directs the envelopes upwardly toward the extractor 110 in the upper section 100.

An overview of the upper section 100 is provided in FIG. 11. More detailed views of the upper section 100 are provided in FIGS. 12-15.

Extraction of Contents from Envelopes

Figure 16:
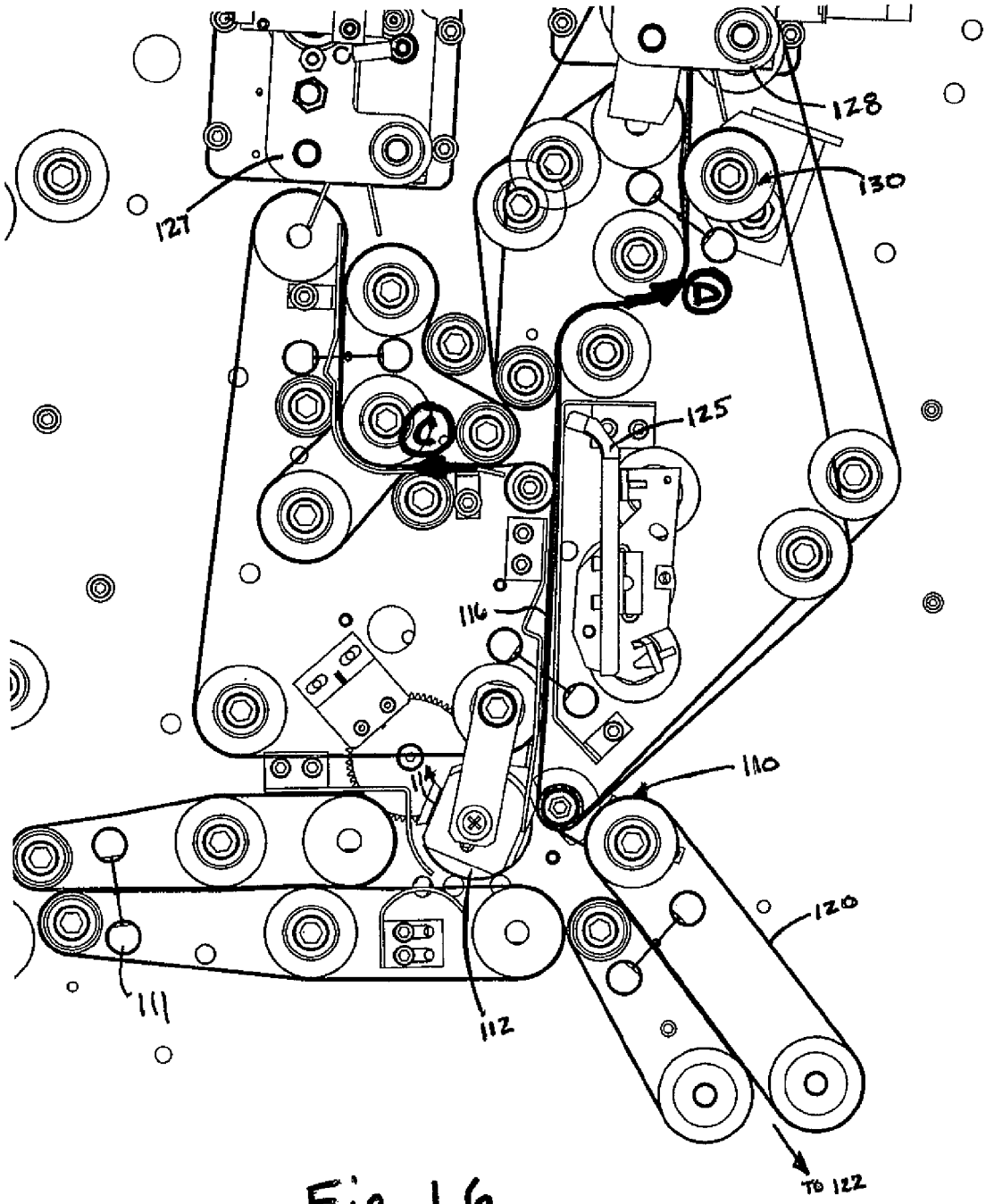
FIG. 16 is an enlarged view of an extractor of the portion of the apparatus illustrated in FIG. 12.

Referring now to FIG. 16, the details of the extractor 110 are more clearly illustrated. The extractor 110 separates an envelope from its contents by peeling off one envelope face and then directing the envelope down one path, and the contents down another path.

The system transport 450 conveys the envelope and its contents past a rotatable extraction head 112. A suction cup 114 mounted in a cavity in the extraction head 112 entrains one face of the envelope, referred to as the leading face. As the envelope passes through the extractor 110, the extraction head 112 rotates so that the leading face entrained by the suction cup is peeled away from the contents and diverted upwardly into an extraction transport 116. At the same time, the contents of the envelope and the trailing face are directed downwardly into a reversible transport 120, which conveys the contents and the trailing face away from the leading face.

The faces of the envelope are conveyed away from one another until the faces are stretched end to end to form a single taut length of paper joined in the middle by what was previously the trailing edge of the envelope. The reversible transport 120 then reverses directions and conveys the contents and the trailing face upwardly into the extractor transport 116.

Figure 12:
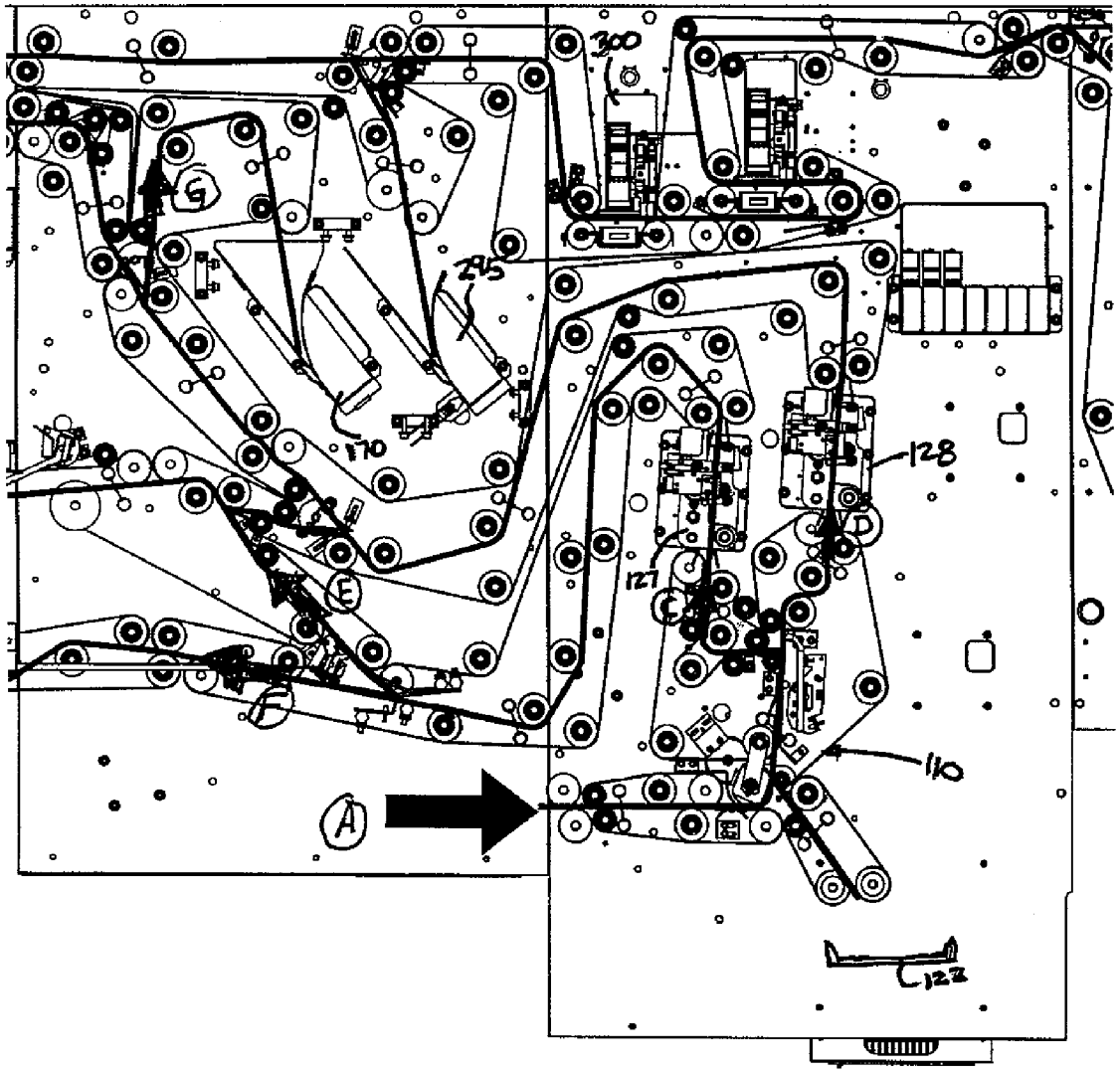
FIG. 12 is an enlarged fragmentary side view of a portion of the apparatus illustrated in FIG. 11 bounded by the area identified as FIG. 12.

A pivotable deflector 125 along the extraction transport 116 directs the leading face toward an envelope path, which is designated C in FIGS. 12, 16. After the leading envelope face enters the envelope path designated C, the deflector 125 pivots away from the extraction transport 116. The trailing face follows the leading face down envelope path C because the faces are connected. However, because the deflector 125 has been pivoted away from the extraction transport 116, the contents of the envelope follow the main path of the extraction transport to a document path designated D in FIGS. 12, 16. In this way, the envelope is separated from its contents.

A pair of thickness detectors 127 and 128 are disposed along the envelope path C and the document path D, as shown in FIGS. 12 and 16. The envelope thickness detector 127 senses the thickness of the envelope as the envelope leaves the extractor 110. The system controller then determines whether the sensed thickness falls within an acceptable thickness range. If the thickness of the envelope is outside the acceptable range, the system controller electronically tags the envelope so that the envelope and its contents are reunited and directed along the path designated E to an envelope reunite bin 160, shown in FIG. 13.

Similarly, if the document thickness indicator 128 indicates a thickness that is outside an acceptable range, it is assumed that either the contents were not properly extracted from their respective envelope or there may be a problem with the contents that could impede further automated processing. The system controller 430 therefore electronically tags the contents so that the contents are reunited with their respective envelope and directed along the path designated E to a reunite bin 160. Alternatively, as discussed below, depending on the thickness determinations, the system controller may electronically tag the contents and direct the contents to a contents reunite bin 170.

If the thickness detectors 127, 128 indicate that the contents have been properly extracted from their envelope, the envelope is directed along the path designated F to a waste container 165 (shown in FIG. 13) and the contents are directed along the path designated D to a singulator 180 that separates the documents within the transaction.

In the present instance, the envelope reunite bin 160 is centrally positioned relative to the upper section 100 and adjacent the operations computer touchscreen 415 so that the operator can readily retrieve the outsorted contents from the reunite bin and process the documents by manually placing the documents into the input bin of a document re-feeding station 200 as discussed further below.

As discussed above, in addition to the envelope reunite bin 160, documents from the extractor 110 may be outsorted and directed down the path designated G to the contents reunite bin 170 (see FIG. 12). The difference between the documents directed to the envelope reunite bin 160 and that the document directed to the contents reunite bin 170 are not reunited with the envelope. Instead only the contents are directed to the reunite bin 170.

There are several reasons that contents may be directed to the contents re-unite bin 170 rather than the envelope re-unite bin. However, the determining factor relates to whether there is a risk that a document will be discarded with the envelope. If such a risk exists, then the contents and envelope are directed to the envelope re-unite bin 160. If there is little or no risk of a document being discarded with the envelope, then the documents are directed to the re-unite bin.

For instance, if the thickness detector 127 that measures the thickness of the envelope measures a thickness that is greater than a pre-determined limit, then there is the possibility that a documents was not separated from the envelope. Therefore, the envelope and associated contents are directed to the envelope re-unite bin 160 to ensure that a document is not inadvertently discarded into the trash 165 with the envelope. In contrast, if the contents thickness detector 128 detects that the contents thickness is greater than an acceptable range there is not an increased likelihood that one of the contents were improperly separated. Therefore, there is little or no need to re-unite the contents with the envelope. This is particularly true if the envelope thickness detector 127 indicates that the envelope thickness is within an acceptable range. Accordingly, if the contents thickness is greater than a pre-determined range, the contents may be directed to the contents re-unite bin 170 rather than directing the contents toward the envelope re-unite bin and re-uniting the contents with the envelope.

Since the documents in the contents reunite bin 170 are separated from the respective envelopes, the operator can quickly and easily manually remove the documents, analyze the documents to ensure that the documents are clean singles, and then process the documents by manually placing the documents into the input bin of the document re-feeding station 200 as discussed further below.

As discussed above, if a transaction is not properly extracted, the envelope and contents are re-united in the envelope re-unite bin 160 or a contents reunite bin 170. In addition, in certain instances it is possible to identify some problem pieces earlier in the process. For instance, if an envelope has a corner that is folded, the adjoining envelope edges may not be completely severed. Consequently, the folded corner may hold the faces of the envelope together as the envelope passes through the extractor. In other words, the extraction head 112 may not peel the back face of the piece away from the contents. Instead, the entire envelope and the enclosed contents will enter the reversible transport. Rather than reversing the reversible transport 120 and conveying the envelope and contents through the thickness detector 128 and to the envelope re-unite bin 160, it may be desirable to simply eject the envelope directly to an outsort bin.

Accordingly, the apparatus 10 comprises an extractor bypass bin 122 for receiving envelopes from the reversible transport. If the system controller 430 determines that an error has occurred during extraction while at least a portion of the envelope and contents are still in the reversible transport 120, the system controller may control the reversible transport to convey the envelope and contents forwardly through the reversible transport and discharge the envelope and contents to the extractor bypass bin 122.

Turning again to the example of an envelope that has not been properly edge-severed, an operation of bypassing an envelope will be described. As the envelope enters the extractor 110, an entry sensor 111 detects the presence of the envelope. During a proper extraction operation, the extraction head 112 entrains the rear face of the envelope and an extraction head sensor 115 detects the presence of the rear face of the envelope within a pre-determined time frame. If the extraction head sensor 115 does not detect the presence of a face of the envelope within the pre-determined time, it may be assumed that the extraction has failed. The system controller 430 then controls the reversible transport 120, causing the reversible transport to convey the envelope and the enclosed contents forwardly to the extractor bypass 122.

In addition to bypassing problem mail pieces, the extractor is also operable to reduce the tendency of contents adhere to a face of the envelope, which can lead to an improper extraction. For example, the flaps that form an envelope may entrain one of the documents in an envelope, preventing proper extraction of the documents. Specifically, during the manufacture of an envelope, a small pocket may be formed between a face of the envelope and a flap that is folded over to hold the envelope together. If one of the documents in an envelope slips into the pocket between the flap and the face, the flap will tend to retain the document in the pocket impeding separation of the document from the face of the envelope.

To improve the separation of the documents from the faces of the envelopes, the extractor 110 may be controlled to attempt to shift or scrub the contents relative to at least one face of the envelope. For instance, as discussed above, the leading face of the envelope is conveyed upwardly into the extraction transport 116 away from the reversible transport until the envelope is pulled taught. The reversible transport 120 is then reversed to drive the front face of the envelope and the contents upwardly into the extraction transport. To attempt to scrub the contents from the envelope, the reversing of the reversible transport 120 is delayed so that the leading face of the envelope is further pulled through the transport, which may pull the attached trailing face of the envelope while the trailing face remains in the reversible transport confronting the contents. Pulling the trailing face may displace the trailing face relative to the contents, which in turn may release contents entrained by the trailing face.

The delay in reversing the reversible transport should be sufficient to pull the trailing face of the envelope. However, if the delay is too long, the tension on the envelope may increase to the point that the trailing edge of the envelope may tear, thereby detaching the leading and trailing faces of the envelope, which will lead to an improper extraction. Accordingly, after the extraction transport draws the length of the envelope taught, the system controller controls the reversible transport by delaying the operation of the reversible transport a predetermined delay time that is between a lower limit and an upper limit. The upper limit is an amount of time that is long enough to likely create sufficient tension in the envelope to tear the trailing edge. The lower limit is an amount of time that is too short to create sufficient tension in the envelope to likely shift the envelope relative to the contents.

Auto-Releasing Pivotable Roller Assembly

Referring now to FIGS. 16-20, a pivoting roller assembly 130 is illustrated. The pivoting roller assembly 130 comprises an idler roller 132 that is operable to pivot radially away from the document path and lock in an open position so that documents in the paper path can be more readily accessed. When the system transport 450 re-starts, the roller 132 is automatically released, so that the roller pivots to a closed position.

Figure 20:
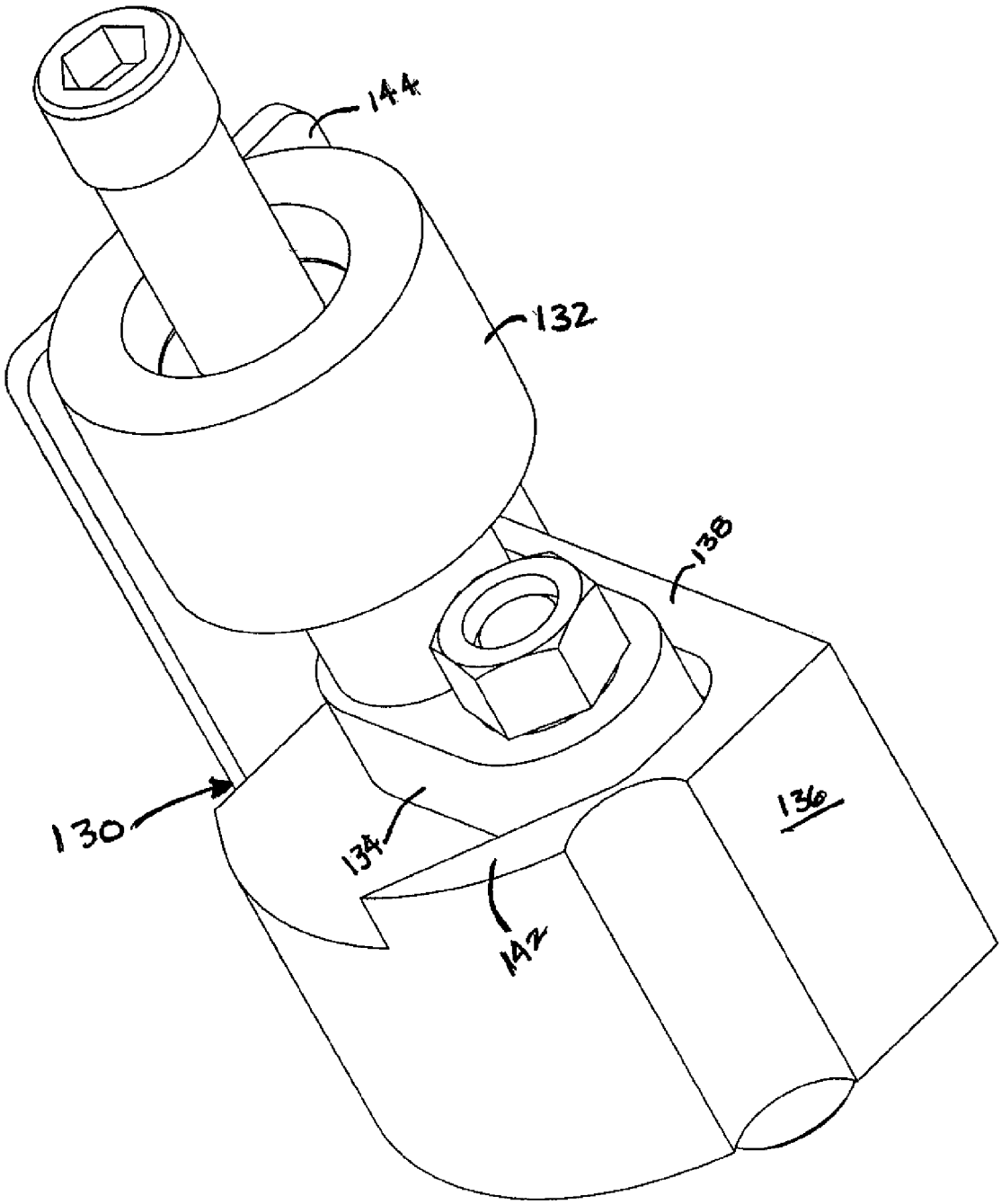
FIG. 20 is a perspective view of the pivoting roller illustrated in FIG. 17.

The pivoting roller assembly 130 comprises a pivotable arm 134 onto which the roller is mounted such that the roller is rotatable relative to the arm. Referring to FIG. 20, the arm 134 is mounted on a base 136 having a first wall 138 projecting upwardly forming an outer stop that limits outward displacement of the pivot arm. A second wall 142 transverse the first wall 138 projects upwardly forming an inner stop that limits inward displacement of the pivot arm. A friction plate 144 attached to the top edge of the base 134 projects upwardly from the base.

Figure 17:
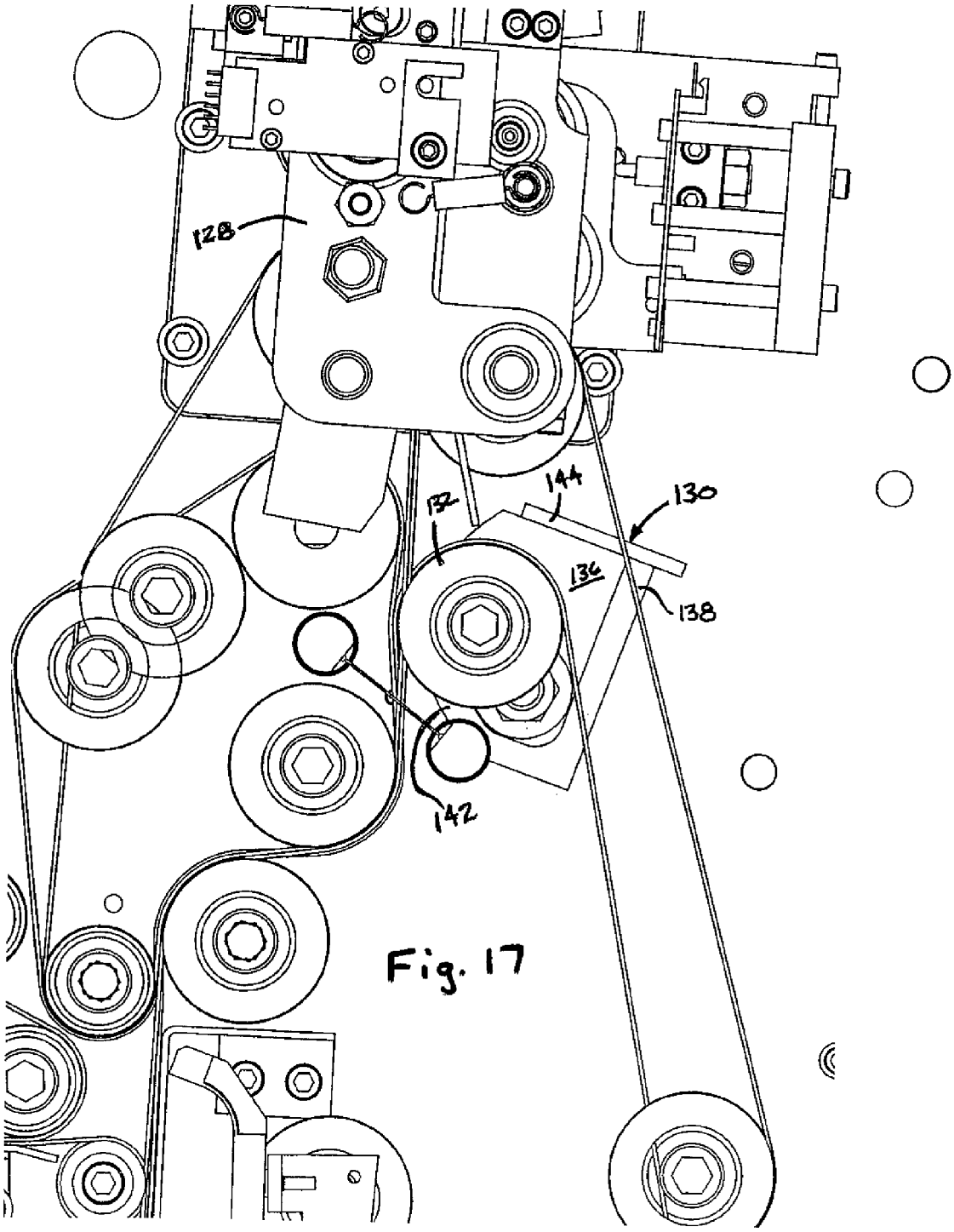
FIG. 17 is an enlarged view of a pivoting roller assembly of the portion of the apparatus illustrated in FIG. 16.
Figure 18:
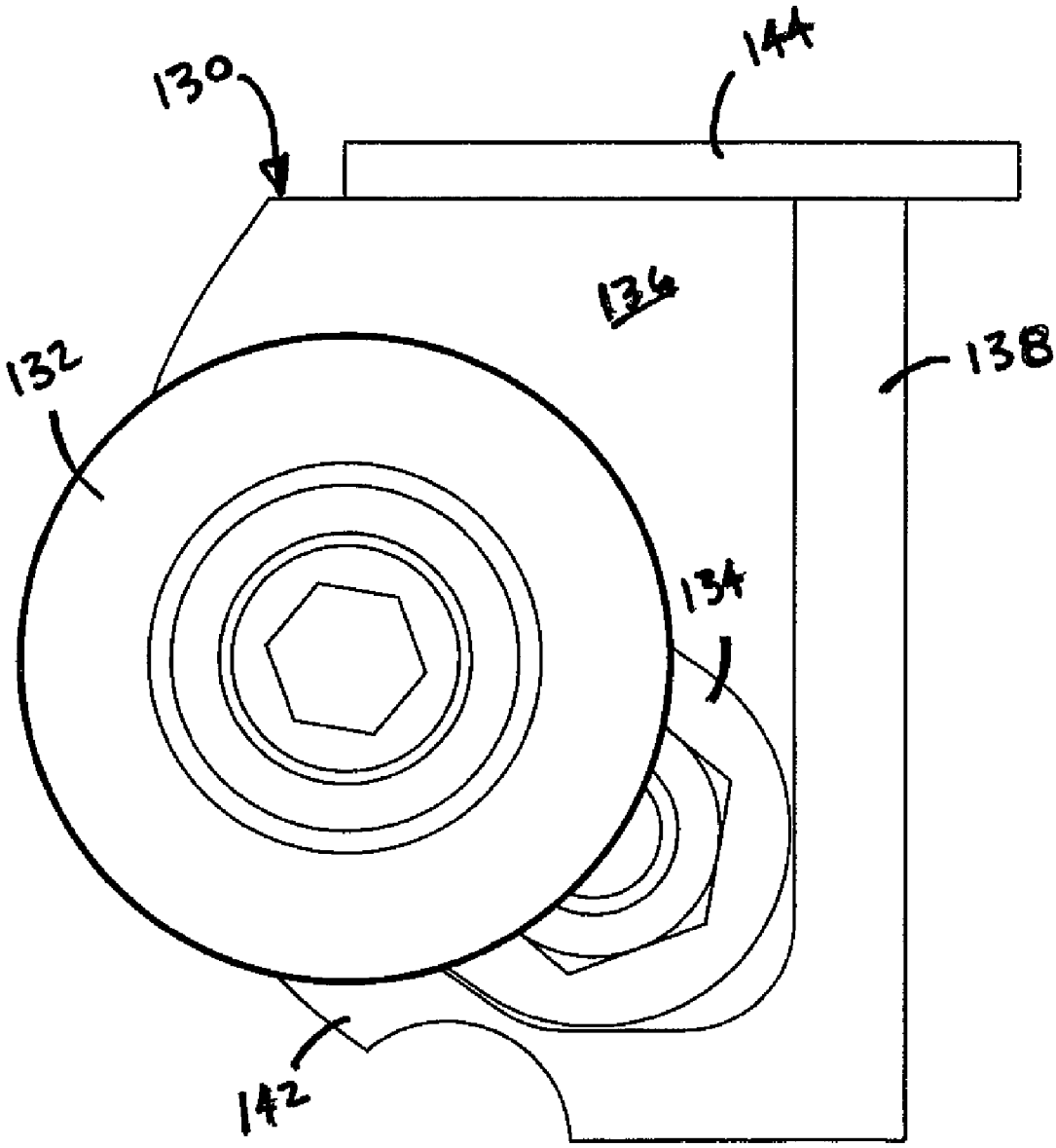
FIG. 18 is an enlarged plan view of the pivoting roller assembly illustrated in FIG. 17.
Figure 19:
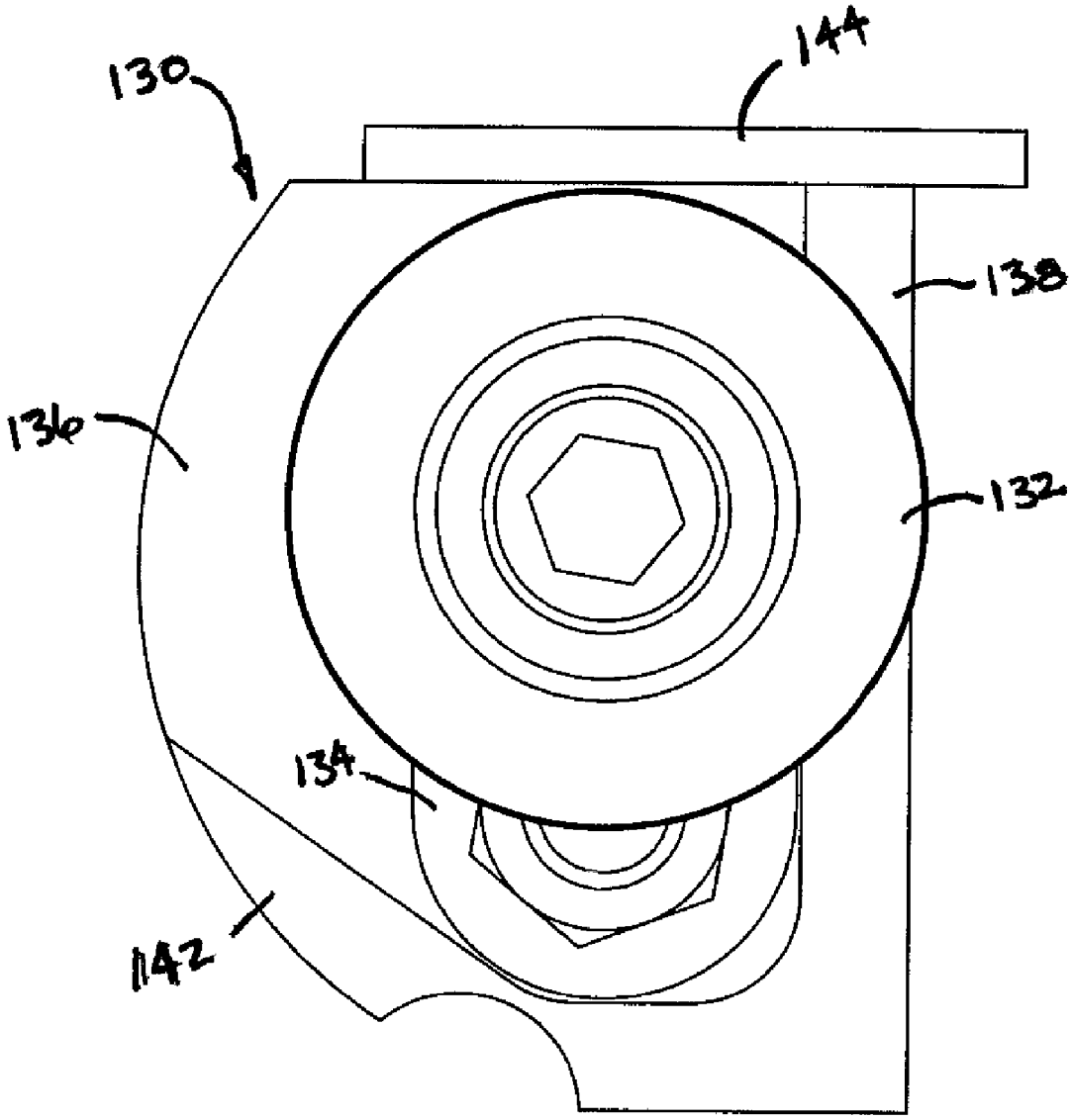
FIG. 19 is a plan view of the pivoting roller assembly illustrated in FIG. 18 showing the roller pivoted to an alternative position.

The pivoting roller assembly 130 is operable between a closed position, illustrated in FIG. 17-18 and an open position, illustrated in FIG. 19. A belt of the system transport is entrained about the roller 132, so that when the roller is positioned in the closed position, the system transport belt is in a normal operating position. More specifically, when the roller is in the closed position, the system transport belt is in close proximity to an opposing belt so that the opposing belts are operable to convey documents along the system transport. Conversely, in the open position, the roller is pivoted away from the paper path thereby displacing the system transport belt away from the opposing belt a distance greater than the thickness of at least two documents so that documents in the paper path can be easily removed.

During normal operation, the tension in the system transport belt biases the roller 132 toward the closed position. After the system transport 450 is stopped, the roller 132 can be pivoted clockwise toward the open position.

The pivoting arm 134 operates as an over the center device. More specifically, the pivoting arm may be positioned in a vertical orientation so that the tensile forces from the belt urging the pivoting arm in a clockwise direction are balanced by the tensile forces from the belt urging the pivoting arm in a counter-clockwise direction. However, the assembly 130 is configured so that when the arm is positioned in the closed position, the arm is left of center so that the tensile forces in the belt urge the arm in a counter-clockwise direction. Similarly, when the arm is positioned in the open position, the arm is right of center, and the tensile forces in the belt urge the arm in a clockwise direction. In this way, when the roller 132 is in the open position, the tensile forces in the belt tend to retain the roller in the open position, and when the roller is in the closed position, the tensile forces in the belt tend to retain the roller in the closed position.

Additionally, the outer and inner stops 138, 142 are configured so that the force necessary to displace the roller from the closed position to the open position is greater than the force necessary to displace the roller from the open position to the closed position. Specifically, in the present embodiment, the outer stop 138 is configured so that the pivoting arm 134 is closer to the center position (i.e. the equilibrium position) in the closed position than when the arm is in the open position. In other words, the angular distance that the arm must be displaced to move from the closed position to the center position is greater than the angular distance that the arm must be displaced to move from the open position to the center position. In addition, in the present embodiment, the outer stop 138 is positioned so that the pivoting arm is relatively close to the center position so that the tensile forces in the belt urging the arm toward the open position are relatively minimal. In this way, less force is necessary to close the pivoting assembly 130 than to open the pivoting assembly.

In addition to the tensile forces in the belt that tend to retain the pivoting arm in the open position, the roller 132 is retained in the open position by frictional engagement between the belt and the friction plate. Specifically, the friction plate 144 is spaced apart from the roller 132 so that when the roller is pivoted into the open position the gap between the friction plate and the roller is less than the thickness of the system transport belt. Therefore, displacing the roller to the open position wedges the roller against the friction plate with the belt between the roller and the friction plate. Further, in the present instance, the friction plate is formed of a deformable material, such as a relatively thin metal (e.g. 3/32" aluminum) so that when the belt is wedged against the friction plate, the friction plate may resiliently deform. The friction between the belt and the friction plate retains the roller in the open position.

The roller assembly 130 can be pivoted toward the closed position manually by displacing the roller 132 counter-clockwise toward the closed position. Once the roller is angularly displaced beyond the center position, the tensile forces in the belt will snap the roller into the closed position.

Additionally, the roller assembly 130 is configured so that the roller will automatically release from the open position and be displaced to the closed position when the system transport is restarted. As mentioned previously, in the open position the roller 132 is wedged against the friction plate 144 with the belt locked between the roller and the friction plate to impede movement of the belt. When the system transport 450 is re-started, the tension in the belt will increase because the belt is wedged between the roller and the friction plate. Specifically, the increased tensile forces will tend to pull downwardly on the right-hand run of the belt (relative to the pulley 132). In response, the forces on the roller urge the roller to the left. Once the roller is displaced over the center position and out of engagement with the friction plate 144, the roller snaps into the closed position as discussed previously.

In the present embodiment, the roller assembly 130 is shown adjacent the thickness detector 128. However, the roller assembly is not limited to such an application. The roller assembly 130 could be utilized in most any application in which an idler roller is utilized to form a nip.

Singulator

Figure 13:
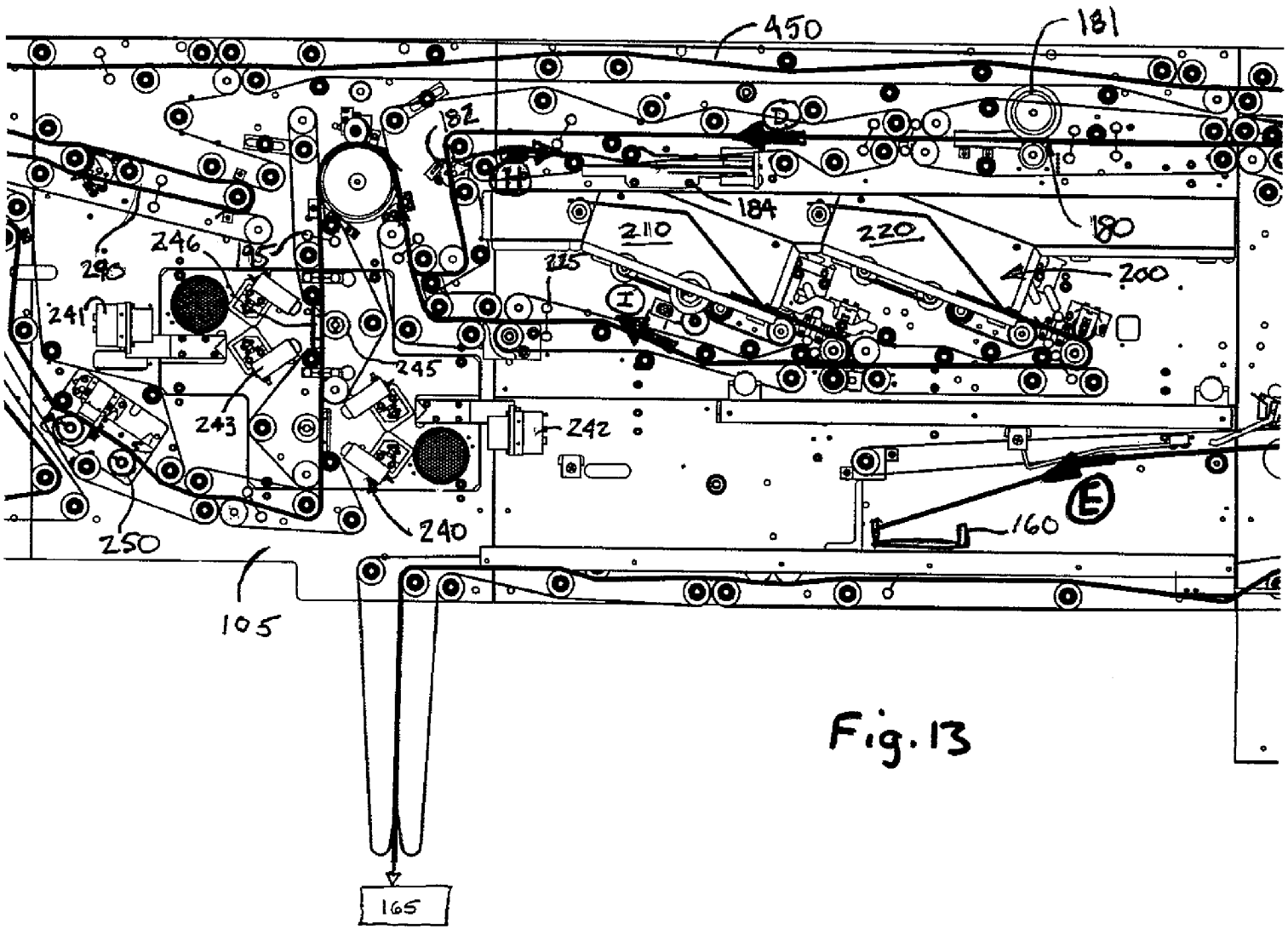
FIG. 13 is an enlarged fragmentary side view of a portion of the apparatus illustrated in FIG. 11 bounded by the area identified as FIG. 13.

Referring now to FIG. 13, the singulator 180 receives the transactional pairs of documents that were extracted by the extractor 110 and separates the documents so that the documents are serially delivered to the orientation section. The singulator includes an idler roller and an opposing drive roller 181. A spring connected biases the drive roller 181 toward the idler roller. The outer surface of the idler roller has a coefficient of friction that is greater than the coefficient of friction of the outer surface of the drive roller 181. In addition, the coefficient of friction of the outer surface of the drive roller is greater than the coefficient of friction between the faces of the pair documents in a transaction. A brake is also provided to stop the rotation of the idler pulley. An entry sensor and an exit sensor track the documents as the documents pass through the singulator 180.

During operation, the system transport 450 conveys a transactional pair of documents in face-to-face arrangement to the singulator 180. The entry sensor senses the leading edge of the pairs of documents as the pair enters the singulator 180, and then after a predefined delay, the brake engages the idler roller to retard or stop the rotation of the idler roller. The pair of documents then enters the nip formed between the idler roller and the drive roller 181. Because the outer surface of the idler roller has a coefficient of friction that is higher than the coefficient of friction of both the drive roller and the faces of the pair of documents, braking the idler roller causes the idler roller to engage and retard the progress of the document confronting the idler roller. At the same time, the document confronting the drive roller 181 is driven past the exit sensor by the drive roller. In this way, the document that was initially confronting the drive roller becomes the leading document of the transactional pair.

Once the exit sensor detects the passage of the leading edge of the leading document, the brake disengages the idler roller after a predetermined delay so that the drive roller 181 drives the trailing document past the exit sensor. The release of the brake is controlled by the system controller in response to signals received from the exit sensor, and is timed to control the gap between the leading and trailing documents in a transaction.

Downstream from the singulator 180, a singulator gate 182 is operable between a first and second position. One or more sensors between the singulator 180 and the gate 182 sense the documents as the documents are conveyed between the singulator and the gate. If the sensors detect that the documents were properly singulated, then the gate remains in the first position, which directs the documents downstream toward imaging and re-orientation sections. If the sensors detect that the documents were not properly singulated, then the sensors send a signal to the system controller 430. In response, the system controller 430 controls the singulator gate 182, displacing the gate to the second position, wherein the documents are directed down the path designated H to a singulator outsort bin 184.

The determination that the documents are not properly singulated can be based on one of several characteristics. For instance, the sensors can be infrared sensor pairs straddling the document path, including an IR transmitter and an IR receiver, similar to sensors that are used throughout the apparatus 10. If a pair of documents are not properly singulated, the documents may overlap so that the documents will appear to an IR sensor as one long document. Accordingly, if an IR sensor detects the leading and trailing edges of a document and the document appears to be longer than an anticipated document, it may be assumed that the document is an overlapping document. In response to signals received from the sensors, the system controller may electronically tag the document(s) and pivot the singulator gate 182 so that the documents are outsorted to the singulator bin 184.

Other characteristics may be sensed to determine whether the documents have been properly singulated to determine whether or not the documents should be directed downstream or to the singulator bin 184. For example, if a documents is excessively skewed, the document may tend to jam in a justifier 190 that is positioned downstream. Accordingly, the skew of the documents may be detected, and if the skew is outside of an acceptable range, the documents are outsorted to the singulator bin 184.

The skew for a document can be detected using a pair of adjacent sensors along the transport path: one sensor positioned to detect an upper portion of the document, one sensor positioned to detect a lower portion of the document. Depending on the time differential between when the first sensor detects the upper portion of the document and when the second sensor detects the lower portion, it can be determined whether the skew of the document is within an acceptable range.

From the singulator 180, the apparatus 10 processes the documents by determining the order and orientation of the documents as the documents are conveyed through the system transport 450. When processing documents in transactions that were extracted from windowed envelopes, the order and orientation of the invoice is known because the customer placed the invoice in the front of the envelope with the preprinted return address visible through the window. Therefore, the sequence of the documents in a transactional pair and the orientation of the invoice in the transaction may be considered constant when processing windowed mail. However, the orientation of the check in a transaction is not constant, and therefore must be determined so that the check can be reoriented if necessary.

For this purpose, the system transport 450 serially conveys the documents to a MICR module 250 that functions to determine the orientation of the checks. The MICR module 250 first imparts a magnetic charge to the magnetic ink on the checks. The orientation of each check is then detected by reading the flux variation of the characters or markings on the check as the check is conveyed past the MICR module 250. The magnetic readings for the checks are interpreted by the MICR module 250 to determine the orientation of each check. The orientation decision by the MICR Module 250 is then transmitted to the system controller 430 which electronically tags the respective document with the orientation decision data.

The MICR module 250 also verifies that the documents in a transaction are in the proper sequence. If the MICR module detects certain magnetic fluctuations in the document after the document has been magnetized, then the MICR module tags the document as a check. Otherwise, the document is tagged as an invoice or as being an indeterminable document. The information regarding the document identification is communicated to the system controller 430. The system controller 430 then electronically tags each document in sequential order as being a check or an invoice based on the data from the MICR module 250. The MICR module 250 then uses the identification of each document to determine if the documents in a transaction are in the proper order. For example, a desired sequence for a transactional pair of a check and an invoice may be invoice first, then check referred to as invoice/check. If the MICR module 250 detects magnetic markings on the first document, then the first document is presumed to be a check and the documents in the transaction are out of order, i.e. check/invoice order rather than invoice/check. The documents in the misordered transaction are electronically tagged by the system controller and directed to a reject bin 295 adjacent the printer 300 (see FIG. 12).

If the MICR module 250 verifies that the documents in a transaction are in order, but the check is not in the proper orientation, the apparatus 10 reorients the check into the proper orientation. For this purpose, the documents may be conveyed down a the path designated J in FIG. 14 to a reverser 260. The reverser 260 functions to reorient the checks, if necessary, by flipping the checks from end to end along the path of movement so that the leading edge becomes the trailing edge and the trailing edge becomes the leading edge. As a result, a selected check may be flipped, if necessary, from front to back along the path of movement. The details of the reverser 260 are illustrated in FIG. 21 and described further below.

Reverser Station

Figure 21:
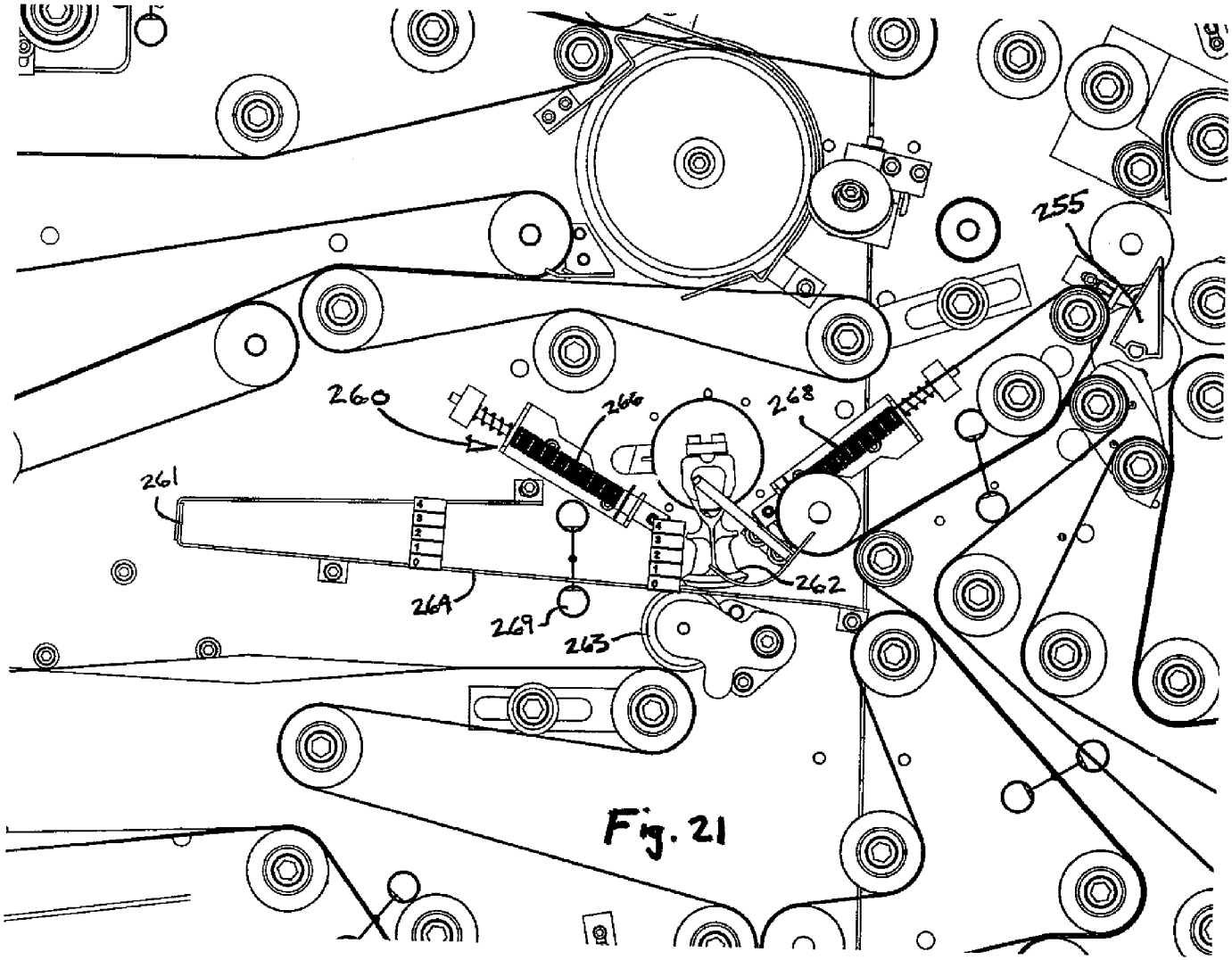
FIG. 21 is an enlarged view of a reverser of the portion of the apparatus illustrated in FIG. 14.

Referring to FIG. 21, in response to the determination of the orientation of documents, the documents are selectively reversed at the reversing station 260. A reverser gate 255 is operable to control which documents are directed to the reverser. Specifically, the gate is controlled by the system controller and is operable between a first position and a second position. When the gate is positioned in the first position, as shown in FIG. 21, the documents are directed along the system transport around the reverser station 260. When the gate 255 is pivoted into the second position, the documents are displaced down the transport toward the reverser station.

The reverser station 260 comprises a pivotable reverser arm 262 positioned adjacent a generally planar guide 264. Opposing the reverser arm 262 along the path of movement is one or more rollers 263 that are spring-biased toward the reverser arm. The guide 264 has a cutout, allowing the reverser arm 262 to project through the guide to form a nip with the roller 263. In this way, when a document enters the reverser, the document is engaged on one side by the reverser arm 262 and on the other side by the roller 263.

The reverser arm 262 pivots between two positions to reverse a document. As a document enters the reverser, the reverser arm is in a first position against a rearward stop 268. In this first position, a small gap exists between the reverser arm 262 and the nip roller 263 so that a document can enter the gap. The reverser arm 262 is actuated at a selected time relative to the movement of the document into the reverser so that the reverser arm 262 is pivoted toward a forward stop 266. As the reverser arm 262 pivots toward the second position, the document in the reverser is nipped between the reverser arm 262 and the nip roller 263. When the arm stops against the forward stop 266 the document also stops.

A sensor 269 indicates whether a document directed to the reverser 260 made it to the reverser or whether the document jammed or was otherwise mis-processed. After a predetermined time, the reverser arm pivots back to the first position and drives the document in the opposite direction that it entered. Just prior to the document engaging the discharge nip a gap develops between the reverser arm 262 and the nip roller 263, releasing the document. At the discharge nip, the document is entrained and drawn into the system transport. In this way, the edge of the document that was the leading edge as the document entered the reverser, becomes the trailing edge, and the trailing edge becomes the leading edge, thereby reversing the document.

The motion of the reverser arm 262 from the first position to the second position is actuated by a rotary solenoid. The motion of the reverser arm may be returned to the first position by a biasing element, such as a spring biasing the reverser arm 262 toward the first position, or by the return stroke of the solenoid. However, in the present instance, the reverser comprises a bi-directional solenoid operable to drive the displace the reverser arm from the second position to the first position.

As discussed above, the reverser comprises forward and rearward stops 266, 268 for limiting the forward and rearward displacement of the reverser arm. The stops can be formed in a variety of configurations. For instance, the stops may be formed out of a cushioning material and fixed in place at pre-determined limits for the displacement of the arm. However, at high rates of processing, the reversing arm 262 may not settle against the stop quickly enough, causing inconsistent timing through the device. Therefore, in the present instance, the stops 266, 268 are formed of a dampening material designed to dampen the impact of the reverser arm against the stops.

Further, rather than using static stops, the present embodiment utilizes dynamic stops that displace when engaged by the arm thereby cushioning the impact of the reverser arm 262 to diminish the bounce of the arm. More specifically, referring to FIG. 21, the forward stop 266 comprises a stack of o-ring shaped dampener elements stacked on an axis. A spring biases the stack forwardly to urge the tip of the forward stop to a predetermined position. As the reverser arm is displaced forwardly, the arm engages the forward stop, causing the forward stop to displace forwardly (toward the left from the perspective of FIG. 21). By yielding when the arm engages the stop, the stop better absorbs the impact of the arm, thereby reducing the potential of the arm bouncing off the stop when the arm impacts the stop. The rearward stop 268 is configured substantially similarly to the forward stop 266 to similarly reduce or eliminate the bounce between the rearward stop and the arm when the arm reverse pivots.

From the reverser 260, the documents are conveyed to a twister 270. If a document is not properly oriented in a right-side-up orientation, the document is directed down the path designated K in FIG. 14 so that the document is reoriented by the twister. The twister 270 reorients a document by flipping the document about a horizontal axis so that the top edge of the document becomes the bottom edge and the bottom edge becomes the top edge. More specifically, the document is transported between belts that twist 180 degrees along the run of the belts. In this way, the document is inverted from an upside-down orientation into a right-side-up orientation. At the same time, because the document is rotated by the twister, the document is also flipped from front to back. Details of the operation of a twisting for selectively re-orienting a document based on the orientation of the document are described in greater detail in U.S. Pat. No. 4,863,037, which is hereby incorporated herein by reference.

In addition to processing documents from windowed envelopes, the apparatus 10 can also be used to process documents extracted from windowless envelopes. When documents are extracted form windowless envelopes, the order and orientation of the documents are unknown. As with windowed mail, the MICR module 250 can be used to determine the orientation of the checks and the order of the documents within a transaction. If the MICR module 250 detects certain magnetic fluctuations in the document after the document has been magnetized, then the MICR module tags the document as a check. Otherwise, the document is tagged as an invoice or as being an indeterminable document. The details of the structure and operation of a MICR module similar to the MICR module 250 in the present apparatus are described in greater detail in U.S. Pat. No. 4,863,037.

In addition, when processing windowless mail, information from the image acquisition module 240 may be used to determine the orientation of the invoices. The image acquisition module 240 cooperates with the system controller 430 to detect the orientation of the invoices based on the image scanned by the cameras 241, 242. A pair of cameras is provided so that both sides of the invoice can be scanned. The cameras are also used to scan both sides of each check.

Figure 14:
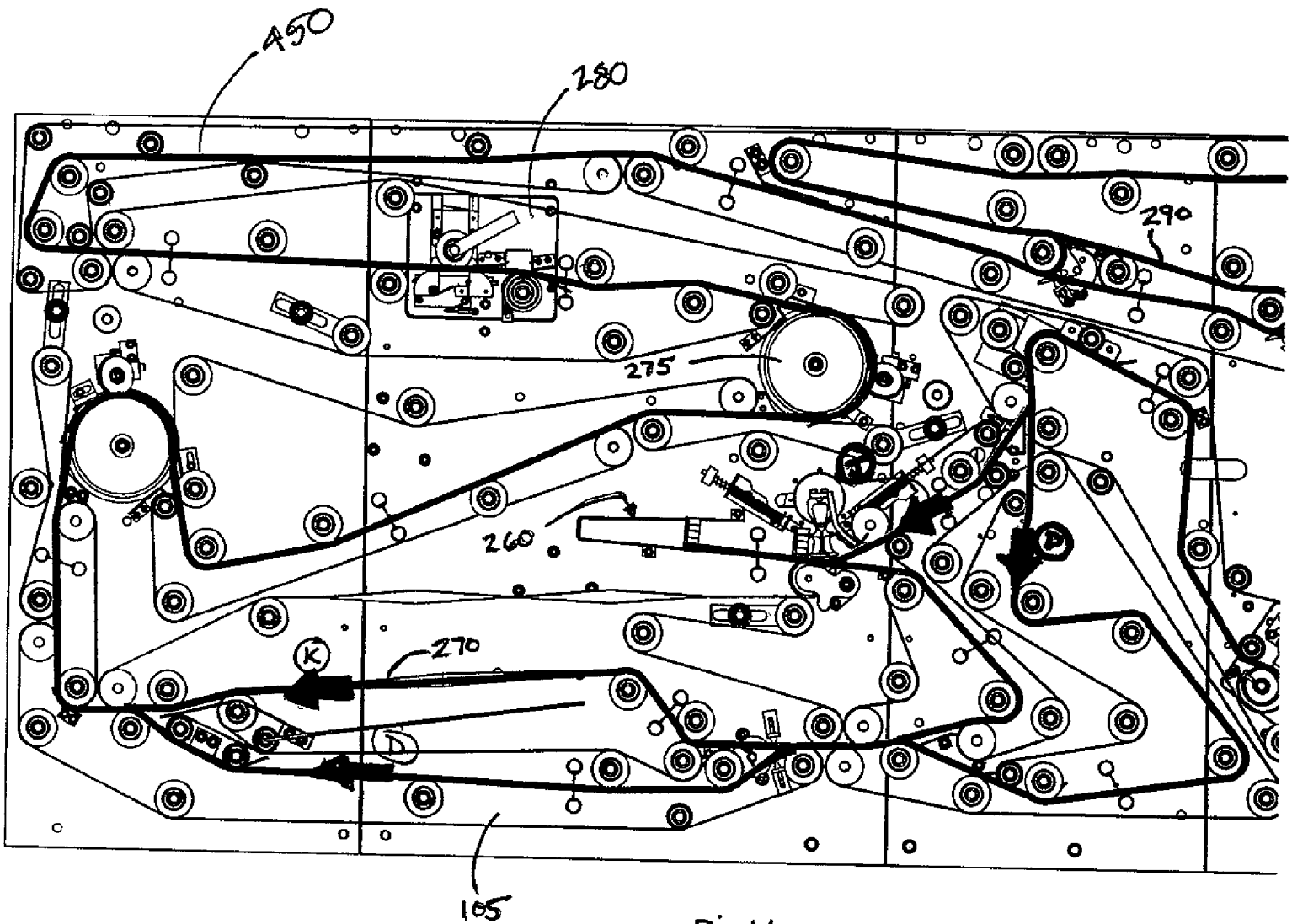
FIG. 14 is an enlarged fragmentary side view of a portion of the apparatus illustrated in FIG. 11 bounded by the area identified as FIG. 14.
Figure 15:
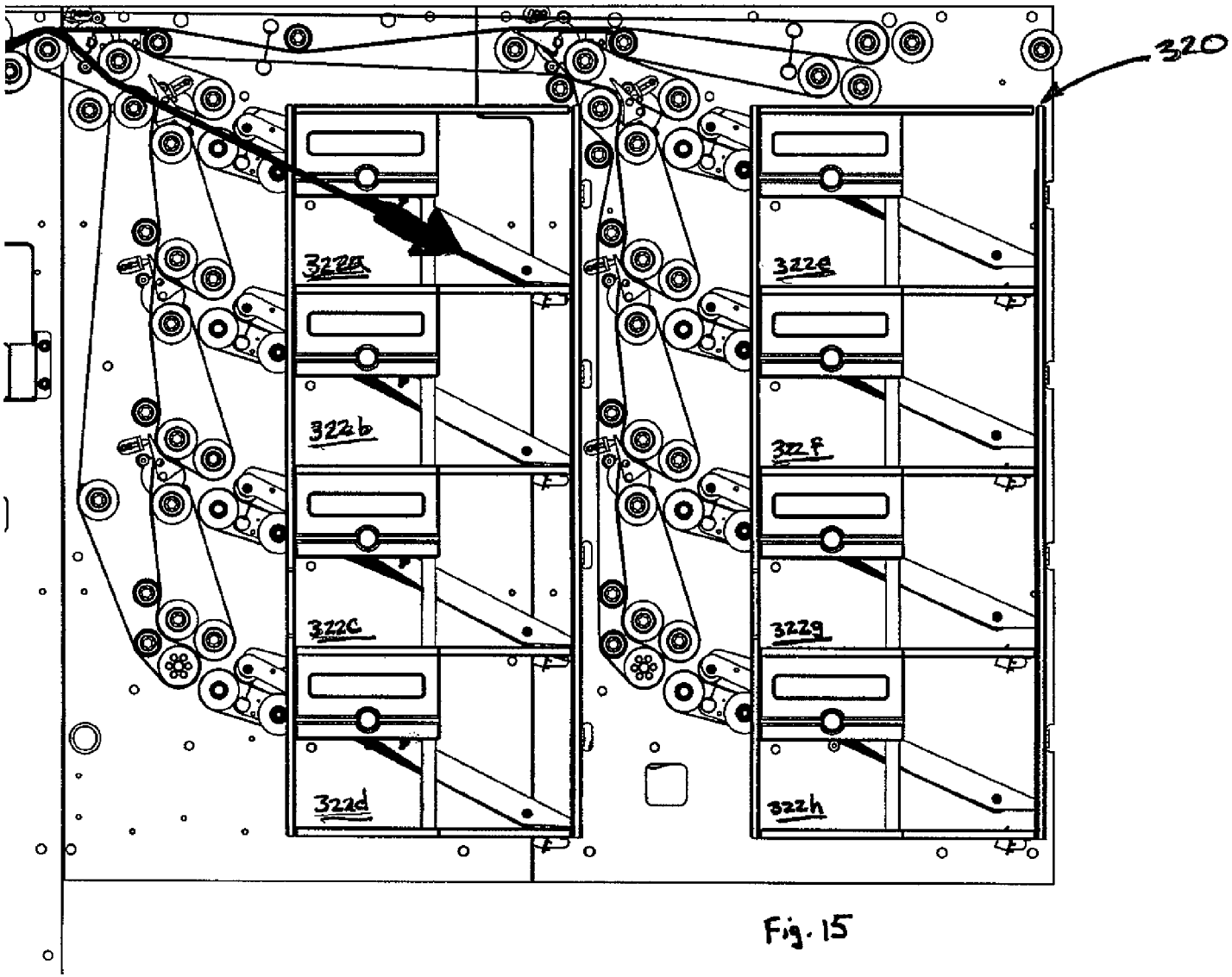
FIG. 15 is an enlarged fragmentary side view of a portion of the apparatus illustrated in FIG. 11 bounded by the area identified as FIG. 15.

When processing windowless mail, because the order of the documents within a transaction is not generally constant, it may be desirable to reorder documents within a transaction that are out of sequence, rather than directing the transaction to a reject bin. For this purpose, when processing windowless mail, it is desirable to include a reordering module 290 along the document path. Referring now to FIGS. 13-14, the reordering module 290 functions to reorder the sequence of two successive documents if the two documents are determined to be in the wrong sequence. For instance, if a corresponding check and invoice are being conveyed so that the check precedes the invoice, in a transaction in which the invoice should precede the check, the reordering module 145 switches the sequence of the check and invoice so that the invoice precedes the check along the path of movement.

If the order of the documents within a transaction is not determined, then the documents in the transaction are electronically tagged by the system controller 430 and processed separately from ordered documents, as is detailed below. Similarly, if the orientation of a document is not determined, then the document along with the other documents in the transaction are electronically tagged by the system controller 430 and processed separately from the properly oriented documents.

Imaging Section

As discussed above, the apparatus 10 preferably includes an image acquisition module 240 that includes at least one line scan camera 241. In addition, preferably the envelope qualification module 30 adjacent the envelope feeder preferably also comprises an envelope image acquisition module that includes at least one line scan camera. In the present instance, the elements of the envelope image acquisition module are similar to the elements of the document image acquisition module 240, the details of which are described further below.

As discussed above, after the documents are singulated, the system transport 450 conveys the documents to the image acquisition module 240. Before entering the imaging section, a justifier 190 justifies the documents. More specifically, the justifier 190 displaces the lower edge of the documents vertically so that the lower edge of each document is aligned or adjacent to a reference height. In the present embodiment, the justifier comprises a drum having a low friction surface, and an angled roller forming a nip. As a document enters the justifier 190, a face of the document confronts the low friction surface of the drum and the angled roller. The angled roller drives the document downwardly toward a ledge that operates as a stop to register the document at a pre-determined vertical position relative to the base plate of the machine.

Along the document path between the singulator and the image acquisition module 240 an image entry sensor 195 detects the presence of a document. The image entry sensor is an infrared sensor employing an infrared emitter on one side of the document path and an opposing infrared receiver on the other side of the document path. The image entry sensor 195 senses the existence of a document, including a leading and/or trailing edge of a document, within the document path at the location of the sensor.

As shown in FIG. 14 the image acquisition module 240 includes at least one high resolution line scan camera 241. The camera 241 is directed toward a plate 246 that is located along the document path. The plate has an aperture so that the documents conveyed past the plate are revealed to the camera 241. A roller 245 having a resilient outer surface, such as foam rubber, confronts the plate forming a nip for receiving the documents being transported through the imaging section. Because the outer surface of the roller 245 is resilient, the roller urges the documents flush against the plate to ensure that the documents are a fixed distance from the camera, for proper focusing, as the documents pass the aperture in the plate. A pair of lights 243 straddling the aperture in the plate 246 illuminate the surface of the documents as the documents pass by the aperture. Each light comprises an array of high-intensity LEDs oriented in a single plane to provide a focused linear beam of light along the aperture.

The imaging camera 241 is mounted in position on the base plate 205 to scan the image of the front face of each document conveyed along the document path. Additionally, the image acquisition module 240 may include a second camera 242 similar to camera 241, but mounted in position on the base plate 105 to scan the image of the back face of each document conveyed along the document path. If a second camera is included, a second plate, a second resilient roller and a second pair of lights that are similar to the plate, roller and lights accompanying the first camera, are also included. Additionally, the second camera 242, interfaces with and is controlled by the imaging computer 420 in the same manner as the first camera 241. In this way, the second camera allows the apparatus to capture images such as customer responses that appear on the back of an invoice.

The imaging cameras 241,242 are high resolution line scan cameras suitable to achieve a 200×200 dpi image resolution. The transport moves at approximately 150 inches per second, and the acquisition rate of each camera is matched to the transport speed so that a 200×200 dpi image resolution is achieved. Although a 200×200 dpi is utilized in the present operation, it may be desirable to utilize a higher resolution such as 300×300 dpi in some applications.

The imaging cameras scan the documents and acquire data representing the light intensity at discrete points of each document. For each point, or pixel, the light intensity is represented by a gray scale number ranging from zero for black to 255 for white. The light intensity for each pixel is communicated to the computer as an eight bit representation corresponding to the gray scale number.

MICR Reader

Referring again to FIG. 14, after the documents are properly oriented by the reverser 260 and the twister 270, the documents are conveyed to a MICR reader 280 that reads the MICR line on the checks. Before being scanned by the MICR reader, the documents are first conveyed to a second justifier 275 that is similar to justifier 190 described above. The documents are justified so that an edge of each of the documents is positioned relative to the base plate 210 of the imaging section so that each document is maintained in proper position for reading the MICR line on the checks.

From the justifier 275, the system transport 450 conveys the documents to the MICR reader 280. The MICR character reader 220 includes a magnet for magnetizing the magnetic ink markings on the checks and a magnetic character read head for reading the characters of the magnetized markings. To scan the MICR line, the documents are first conveyed past the magnet which imparts a magnetic charge to the magnetic ink on the checks. The documents are then conveyed past the magnetic character read head which detects the variations in magnetic flux as the magnetized markings of the checks are conveyed past the read head. After reading the variations in magnetic flux, the MICR character reader determines the characters that make up the MICR line of each magnetized check. The MICR module 280 then communicates the data representing the MICR line to the imaging computer 420.

Once the image data is transferred to the imaging computer 410, the image data is processed to determine various data about the document and/or the transaction. For instance, the imaging computer 410 may attempt to read the OCR line if the document is an invoice or the MICR line if the document is a check. The OCR line data may be necessary for later remittance processing because the OCR line for an invoice includes information about the customer's account and the amount of the invoice. During remittance processing, the customer account number must be known so that any payments can be posted to the correct account. In addition, during remittance processing the invoice amount needs to be known because of the method typically used to determine the amount of a check. To determine a check amount during remittance processing, the amount of a check is either manually or automatically compared with the invoice amount. If the check amount matches the invoice amount, then it is assumed that the check amount was properly read. If the two amounts do not match, then the check amount is rekeyed. Therefore, for further remittance processing the OCR line data, which includes the invoice amount and account number, is needed.

Based on data received from the system controller 430, the imaging computer 410 knows whether a document is a check or an invoice. If the image represents an invoice, the imaging computer 410 processes the image data for the document in order to determine the document's OCR line, which typically appears at the bottom of invoices. The OCR line is a series of characters printed in a uniform predefined typeface of predefined size. Commonly, the typeface is a type referred to as OCR A, however, typeface OCR B, E13B and others can also be read.

In addition, the imaging computer 410 can function to process the image data to read the MICR line of checks so that the MICR line is read both optically and magnetically by the MICR reader 280. As previously described, the MICR character 280 magnetically reads the MICR line on checks. However, the MICR character reader may be unable to read one or more characters in a MICR line because of imperfections in the magnetic characteristics of the MICR line ink. These magnetic imperfections, however, may not affect the imaging computer's ability to read the MICR line from the optical image data, so that a character that cannot be read magnetically may be readable optically. Therefore, if the MICR reaches 280 is unable to read a character in a MICR line, the data obtained optically is used to supplement the data obtained from the MICR character reader in an attempt to complete the MICR line data.

Alternatively, it may be desirable to use the imaging computer to verify the results from the MICR character reader 280. By verifying the results, the possibility of checks being processed with improper MICR data is reduced. For this purpose, the MICR line data obtained optically can be compared with the MICR line data from the MICR reader 280. If there is any mismatch between the optically read MICR line and the results from the MICR character reader 280 the imaging computer indicates that the MICR line was not determined. The system controller 430 then tags the document as having an undetermined MICR line and the document along with the remaining documents in the same transaction are directed to the reject bin 295 or sorted by the stacker 320 accordingly.

The image data for a document is combined with the data representing either the MICR line or the OCR line, along with data from the system controller 430 to form a data record for the document. The data from the system controller 430 includes information from the envelope from which the particular document was extracted, such as a change of address indication, the presence of a postnet barcode, and the presence of a mark indicating a customer response. The data from the system controller 430 also includes an indication of whether the MICR line and OCR line was completely determined during imaging. Accordingly, the data record for a document includes the image data, the MICR or OCR line, an indication of whether the OCR or MICR line is complete, and miscellaneous information obtained during the processing of the document, such as customer response data in the form of a change of address, or a check mark in a response mark.

Injecting Extracted Documents

Figure 22:
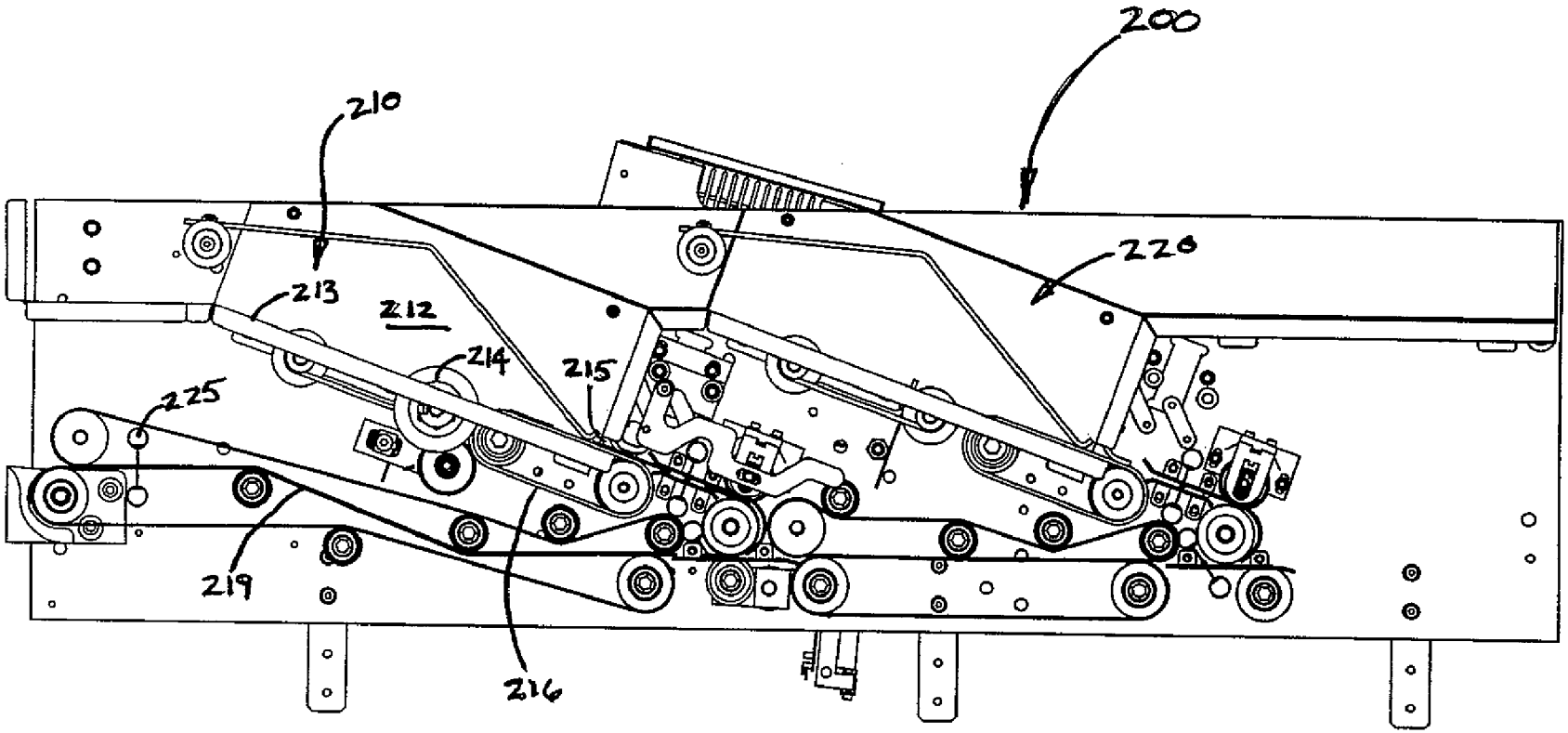
FIG. 22 is an enlarged view of a document feeding station of the portion of the apparatus illustrated in FIG. 13.
Figure 23:
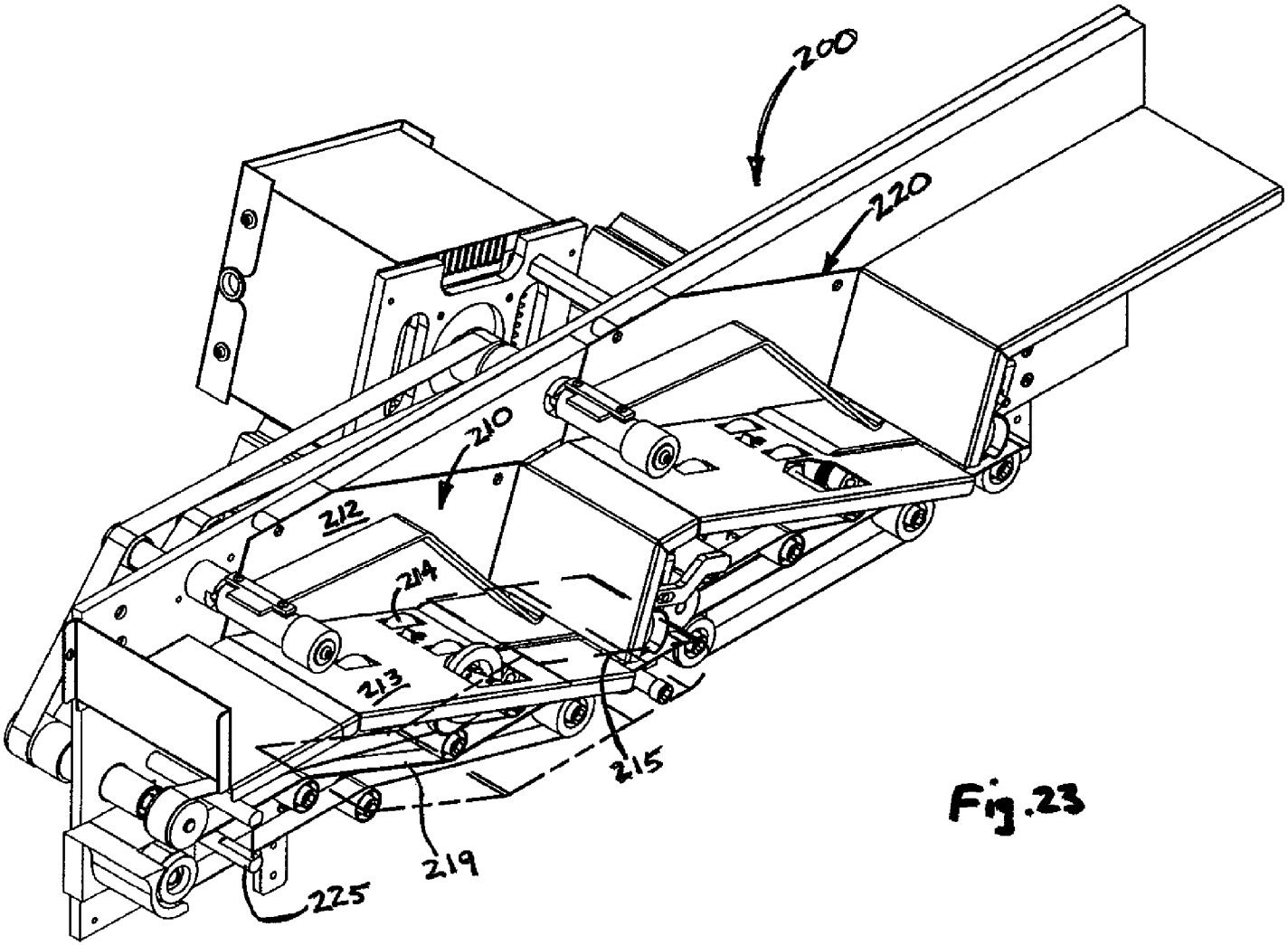
FIG. 23 is a perspective view of the document feeding station illustrated in FIG. 22.

Referring now to FIGS. 13, 22 and 23, the apparatus 10 includes a document feeding station 200 for injecting documents into the flow of documents in the upper section 100. The document feeding station comprises two feeders 210, 220 for serially feeding documents. The elements of the two feeders are substantially the same. Accordingly, the following discussion will describe the features of the first document feeder 210.

The first feeder 210 comprises an input bin 212 configured to receive a stack of documents. The input bin 212 comprises a base plate 213 angled downwardly. A plurality of rollers 214 project upwardly from the base plate 213 to engage the bottom of the stack of documents. The rollers 214 are rotatable to urge the documents forwardly toward a feed slot 215. In the feed slot 215, a feed belt 216 opposes a retard element. As a document enters the feed slot 215, the feed belt 216 drives the bottom document forwardly, while the retard element holds back the document on top of the bottom document to prevent a double feed.

From the feeder 210, the document is displaced down a path designated I in FIG. 13, which is also referred to as a feeder transport 219 in the following discussion. The feeder transport 219 intersects the system transport 450 prior to the justifier 190 upstream from the image acquisition module 240. In addition, as shown in FIG. 13, the first and second document feeder 210, 220 share the same feeder transport 219. In other words, document from both feeders pass through the feeder transport 219 to enter the system transport.

A staging sensor 225 disposed along the feeder transport 219 is operable to detect the presence of a document. As discussed further below, a document is maintain or staged in the feeder transport 219 at a staging area adjacent the staging sensor 225. From the staging area, the document is then injected into the flow of documents in the system transport adjacent the justifier 190.

The document feed station 200 is operable to feed a variety of documents. However, as discussed further below, the document feed station 200 is particularly suited to accommodate feeding a first type of document from the first feeder 210 and a second type of document from the second feeder 220 as discussed further below.

According to one mode of operation, the document feed station 200 is utilized to feed both batch tickets and extracted transactions. Specifically, the first document feeder 210 is used to feed batch tickets and the second document feeder 220 is used to feed transactional documents.

Generally, to facilitate remittance processing, batches of documents are separated by various control documents such as a batch header ticket that may be placed at the beginning of each batch, a batch trailer ticket that may be placed at the end of each batch and a control ticket that may be placed behind the batch header ticket. To automatically feed the various control documents into the different batches, the document feeder 210 operates as a batch ticket feeder. In this mode of operation, the first document feeder 210 feeds batch tickets into the document path so that the batch tickets enter the system transport 430 just prior to the justifier 190.

In the batch ticket feeder mode, the first document feeder 210 can operate to meet various requirements for placing a number of batch tickets and/or other control documents at the beginning of each stack of documents in the stacker 320.

In a basic mode, batch header tickets are fed for each batch of documents, a batch header ticket may be fed for the invoices in a batch and one batch header ticket is fed for the checks in the batch. The batch header tickets are loaded into the first document feeder 210 so that the corresponding batch header tickets for each batch of documents are adjacent.

Each bin in the stacker 320 has a bin sensor that sends a signal to the system controller if the bin is empty. In response to an indication from a bin sensor that a bin is empty, the system controller prompts the first document feeder 210 to feed a batch ticket. The batch tickets flows from the document feeder 210 to the justifier 190, which justifies an edge of each batch ticket relative to the base plate 105 so that each batch ticket is maintained in proper position for optical imaging. The batch tickets are then conveyed past the image acquisition module 240 and image data is acquired for the batch tickets.

After imaging, the batch tickets are conveyed past the MICR reader 280 which determines the characters that make up the batch ticket number. The MICR reader 280 then communicates the batch ticket number to the imaging computer 410 which communicates the batch ticket number to the system controller 43. The system controller then uses the batch number to monitor and control the processing of the corresponding batch of documents. For example, if the MICR reader 280 reads a batch ticket MICR line and determines that the batch ticket number is 1000, the information is then communicated to the imaging computer and in turn to the system controller 430. The system controller then assigns checks and invoices into batch 1000. When a document enters the image acquisition module 240, the system controller informs the imaging computer that the document should be imaged and assigned to batch 1000. As this example illustrates, the batch ticket MICR data is communicated back and forth between the imaging computer after the MICR reader 280 reads the batch ticket. After being imaged and having the MICR lines read, the batch tickets are conveyed to the stacker 320, which sorts the batch tickets into the empty bins.

The batch tickets are fed to the stacker 320 along the same document path that the invoices and checks are transported. During normal operation of the apparatus 10, the gap between adjacent checks and invoices is too small for a batch ticket to be fed into the flow of documents along the document path. Further, it is not desirable to stop the processing of the checks and documents to feed batch tickets.

One method of feeding batch tickets without halting the processing of checks and invoices utilizes the time delay that occurs during the initial startup of the machine and during recovery after a jam. When the apparatus is first started, there are no documents in the system transport 450. Therefore, when the apparatus 10 is initially started, there is a delay between the time the envelopes are placed onto the feed conveyor 22 and the time that the documents are extracted and processed so that they reach the point where the batch tickets are fed into the system transport. During this delay, the first document feeder 210 feeds batch tickets into the system transport. The document feeder continues to feed batch tickets until either all of the empty bins in the stacker 320 are full or until a sensor indicates the presence of a check or document in the system transport adjacent the point that documents from the document feeder station enter the main document path.

A second method for feeding the batch tickets without halting the processing of checks and documents utilizes the gaps in the flow of documents that occur when a transaction is outsorted or if a transaction is reunited with its envelope after extraction. As previously described, during the processing of the documents, certain envelopes are directed to different outsort bins, such as the envelope reunite bin 160, the content reunite bin 170 and the singulator outsort bin 184. When a transaction is outsorted, a gap occurs in the continuous flow of documents along the system transport 450. This gap is monitored by the system controller 430, which, in turn, indicates to the first document feeder 210 when a batch ticket should be fed so that the batch ticket merges in the gap in the document flow created by the outsorted transaction.

More specifically, in response to a signal from one of the bin sensors in the stacker 320 that a bin is empty, the first document feeder 210 feeds a batch ticket from the stack of batch tickets and stages the batch ticket adjacent the staging sensor 225. The system controller then controls the operation of the document feeder module 200 to advance the staged batch ticket so that the batch ticket enters the gap in the flow of documents. If further batch tickets are required, the first document feeder 210 feeds a subsequent batch ticket that is advanced to the staging area adjacent the staging sensor 225. As with the first method for feeding batch tickets, the document feeder feeds batch tickets into the gaps in the document flow as long as there are empty bins in the stacker.

While the system controller controls the first document feeder to inject batch tickets into the system transport, the system controller also controls the second document feeder 220 to inject transactional documents into the system transport.

As described above, the second document feeder 220 is substantially similar to the first document feeder 210. Continuing with the method of operation in which the first document feeder feeds batch tickets, and the second document feeder feeds transactional documents, the operation of the second document feeder 220 will be described in greater detail.

Prior to feeding transactional documents, the documents are analyzed to ensure that the documents are clean mail. In the present instance, the mail is extracted and analyzed to ensure that the transactions are singles transactions that do not have a characteristic that would render one or both of the documents inappropriate for processing. For instance, the documents are inspected to ensure that the documents are not damaged or connected, such as by a staple.

The transactional documents in the feeder may be mail that is opened by a separate mail processing device. In addition, the documents may be documents that the apparatus outsorts to one of the outsort bins. For instance, the operator may remove a stack of documents from the contents reunite bin 170 and place the documents into the feeder 220. Since the documents in the contents reunite bin 170 have been separated from the envelopes, the operator can efficiently examine the contents manually and then place clean singles into the second document feeder 220.

As with the first document feeder 210, rather than injecting the envelopes into the system transport directly from the feeder, the second document feeder feeds documents into the feeder transport 219 and stages the documents in the staging area adjacent the staging sensor 225. Specifically, when processing singles, the feeder 220 feeds two documents (i.e. a transaction) from the input bin and into the feeder transport 219. The two documents are staged in the feeding area. Once the system controller identifies a gap in the flow of documents sufficient to accommodate the two documents, the system controller controls the operation of the feeder transport to feed the documents into the system transport so that the documents intersect the gap in the flow of documents.

Since the first and second document feeders 210, 220 share the same feeder transport 219, documents from the feeders may jam if both feeders feed documents at approximately the same time. Accordingly, the system controller controls the operation of the feeders 210, 220 to prevent the documents from jamming. Specifically, returning again to the batch ticket/transactional document methodology, the system controller prioritizes the batch ticket feeding over the transactional document feeding. Accordingly, if a transactional pair of documents are staged in the staging area and a bin sensor in the stacker indicates that a batch ticket is needed, after the transactional pair are fed into the system transport, the first feeder 210 feeds a batch ticket to the staging area rather than feeding more transactional documents. The first feeder 210 will continue to feed batch tickets until a sufficient number of batch tickets are fed. In this way, the second feeder will not feed documents to the staging area as long as there is a need for a batch ticket.

Although the present methodology is directed to processing singles transactions, either of the document feeders may be used to process other types of transactions such as multi transactions, invoice only transactions and check only transactions. The term multi includes three different types of transactions: two or more checks and one invoice, two or more invoices and one check, and finally, two or more checks and two or more invoices. A check only transaction is a transaction that does not have an invoice. Similarly an invoice only transaction does not have a check.

In addition to the methodologies described above, the document feeding station 200 is operable according to a variety of other methodologies. According to an alternative methodology, both feeders 210, 220 may be used to feed the same type of document. For instance the feeders 210, 220 may both be filled with transactional documents. In such a situation, the system controller will continue to feed documents from the first feeder 210. Once the first feeder 210 is empty, the system controller will automatically switch to the second feeder 220 to continue feeding documents.

Advanced Processing & Sorting

As discussed previously, during the processing of the documents, images of the documents are obtained, the document-type for each document is determined (i.e. whether the document is a check or an invoice), the OCR lines for invoices are determined, and the MICR line for checks is determined. Based on the data determined for the documents in a transaction, the apparatus is operable to perform a wide variety of analyses to determine further information about each document in a transaction and/or about the transaction.

Referring to FIG. 11, the image acquisition module 240 and the MICR reader 280 are disposed in the upper section 100 remote from the stacker 320. Further, as shown in FIG. 14, after the documents pass through the MICR reader 280, the document transport continues toward the left end of the upper section 100 before turning toward the stacker 320. The documents are then conveyed along substantially the entire length of the upper section 100 on the way to the stacker. This elongated run of the system transport 450 provides additional time (approximately 500 milliseconds) to process information about the documents to determine various information, such as how the documents should be processed during remittance processing. After making the determination, the documents may be sorted in the stacker according to the determination, as discussed further below.

CAR/LAR Processing

One type of processing that can be done for the documents is to attempt to automatically read the check amount so that the check amount does not need to be keyed in later by an operator. One method for determining the check amount is to perform a courtesy amount read/legal amount read analysis, referred to as a CAR/LAR analysis, in which the image data for the check is analyzed to read the check amount.

The check amount is normally written in two places on a check: in numerical form in the courtesy box, and in word form on the payment amount line (referred to as the legal amount). The numerical form in the courtesy box may be easier to read, however, the results can be less reliable (e.g. it is easy to mistake a 4 for a 9 depending on the hand writing). Conversely, the legal amount is more difficult to read automatically, but the results are typically more reliable (e.g. the word four is easily distinguishable from the word nine).

During the CAR/LAR analysis, the image data for a check is analyzed to identify the portion of the image data that includes the courtesy amount and the portion that includes the legal amount. Since the checks may be either handwritten or machine written, a variety of pattern matching techniques may be utilized to attempt to identify the characters in the courtesy amount portion of the document and the characters in the legal amount portion of the document.

If the CAR/LAR analysis is able to read both the courtesy amount and the legal amount, and the two amounts match, it may be presumed that the check amount was properly determined. The transaction is then identified as having a check amount determined and may be sorted separately in the stacker. For instance, all of the checks that have had the check amount determined may be directed to a particular bin. The documents can then bypass the check amount determination procedure during subsequent document processing.

Additionally, if the CAR/LAR analysis is successful and the check amount is determined this information is added to the data record for the check so that the data is known during subsequent processing. More specifically, the data record for the check may indicate that a CAR/LAR analysis was performed, that the analysis was successful, and the identified check amount. Similarly, if the CAR/LAR analysis was not successful, the information may also be added to the data record so that the document is processed accordingly during subsequent remittance processing. For instance, for documents that the CAR/LAR analysis was unsuccessful, the documents (and/or images) may be sorted accordingly, and then subsequently directed to a remote operator to manually read and key in the check amount.

In the example above, the check amount is determined solely based upon the data for the check. However, it may be desirable to evaluate information for one document in a transaction based upon information for a separate document in the transaction. Returning again to the CAR/LAR analysis, as discussed previously during processing of the invoices, the image data for an invoice may be analyzed to read an OCR line, which typically includes the invoice amount. If the CAR/LAR analysis for the check amount matches the invoice amount as determined by the OCR analysis for the invoice, then there is a greater degree of confidence that the check amount was properly determined. In some applications it may be desirable to separate transactions (or just the checks) for which the CAR/LAR analysis matches the invoice amount from the transactions (or just the checks) for which the CAR/LAR analysis does not match the invoice amount.

Similarly, the invoice amount information can be used in other ways to determine how to process the check in the transaction. For instance, if the CAR/LAR analysis is performed, and the courtesy amount does not match the legal amount, but one of the amounts matches the invoice amount, it may be presumed that the payment amount is the invoice amount. However, since the CAR/LAR analysis was not successful, the confidence in the check amount determination is not as high as if the CAR/LAR was successful. Accordingly, the transaction may be sorted separately so that the transactions are processed accordingly. For instance, the checks may be separately analyzed to simply validate that the check amount is the same as the invoice amount.

Image Verification

Another analysis that can be performed prior to sorting the documents is an image quality check, particularly for the checks. With the advent of CHECK 21 procedures, a replacement check can be used during the check clearing process, rather than the paper document. The replacement check is produced using scanned images of the check. Since the image may be used rather than the paper document, it is important to ensure that the scanned image meets certain image quality standards.

Accordingly, prior to sorting a check in the stacker 320, the image data for the check may be analyzed to determined whether the image meets image standards that must be met to clear the check using the image rather than the paper copy. During the quality check analysis of the image data, various characteristics may be analyzed. For instance, the image data may be analyzed to ensure that: (1) the image is neither too light nor too dark; (2) the image is not excessively skewed; (3) the image is a complete image; (4) the image does not contain streaks or bands (either light or dark); and (5) that the image size is neither above a maximum image size nor below a minimum image size. All of the characteristics are not necessarily evaluated for every batch, and in some instances, different characteristics may be analyzed to evaluate the quality of the image.

If the analysis of the check image indicates that the quality of the image is not sufficient for use in an automated or truncated clearing procedure, the check and/or the transaction may be electronically tagged and sorted separately from checks/transactions that do meet the image quality criteria. In addition, the data regarding the check image quality may be added to the data record for the check and/or transaction.

Database Look-Up

In addition to the processes discussed above, data regarding a document or transaction may be used to determine other information about the document or transaction through the operation of one or more database look-up procedures. The information identified during the database look-up may then be used to determine how to sort the document or transaction.

For instance, it may be desirable to separate transactions or documents based on the customer account. More specifically, a company may desire to separate payments that are received from certain customers. For instance, it may be desirable to separate customer accounts that have a history of providing checks that are returned for insufficient funds. Therefore, before the transaction is sorted in the stacker 320, the customer account number (as determined by the OCR line on the invoice) is compared against a database of accounts to be flagged. If the account number matches an account on the list, the check and/or transaction is electronically tagged and sorted separately in the stacker 320.

Similarly, it may be desirable to determine whether a transaction qualifies for processing the check using an ARC/ACH procedure that converts the check payment into an electronic payment. However, there are numerous limitations on what checks can be converted into ARC payments. For instance, commercial checks and money orders are not eligible for conversion. In addition, customers may opt out so that their payments may not be converted. Although there are limitations on the checks that can be converted into electronic payments, the cost of clearing the checks by converting the checks into electronic payments is lower than other procedures for clearing checks. Therefore, it may be desirable to identify and separate transactions that are eligible for ARC processing.

To identify transactions that are eligible for ARC conversion, both the OCR line from the invoice and the MICR line from the check may be utilized. Specifically, as mentioned previously, the OCR line includes the customer account number. The account number can be compared against a database to ensure that the customer has not opted out of ARC procedures. Similarly, the customer's bank account information identified in the MICR line on the check may be compared against a database to determine whether the transaction qualifies for ARC conversion.

In addition to the analyses identified above, numerous other analyses may be performed to determine how a document should be subsequently processed, and in particular, what procedure should be used and/or may be available based on various criteria. For instance, many checks can be cleared using the check images rather than the original check. However, certain financial institution will not accept images; a paper document is required. Although the CHECK 21 legislation requires financial institutions to accept image replacement documents, it does not require a financial institution to accept the electronic images. Further, although it is possible to create an image replacement document using the check images and data that can be extracted from the check images, it is normally easier to simply preserve the check and submit the original check rather than destroying the check and then producing an image replacement document. Accordingly, since the MICR line includes data identifying the bank issuing the check, the bank data can be checked against a list or database to determine whether the check images can be used to clear the check or whether the original check should be used.

Although the various remittance processing procedures have limitations, as discussed above, typically a check may qualify for processing under more than one procedure. Further analyses can be done to determine which remittance processing procedure should be utilized based on other data as well. For instance, various criteria can be evaluated to determine which of several check clearing procedures should be used for a particular check. More specifically, a check clearing procedure can be determined based on factors such as the dollar amount of the check, the time the check is processed, the cut-off time for the different check clearing procedures, and the cost charged to clear a check according to the different procedures. Once the proper check clearing procedure is determined, the transaction may be sorted into the stacker 320 accordingly.

As discussed above, various characteristics can be determined for the transactions based on analyses of the data determined during processing of the documents. These characteristics can be used to subsequently sort the transactions in the stacker 320. For instance, the checks can be sorted according to the clearance process to be used for the check and the processing that is still required for the document. For example, checks that have images of sufficient quality for CHECK 21 processing and that have had the check amount determined during a CAR/LAR analysis (i.e. checks that are ready to clear) are directed to a first bin. Checks that have images of sufficient quality for CHECK 21 processing, but have not had the check amount determined are directed to a second bin. Checks having images that do not qualify for automated clearing procedures are directed to a third bin, and checks that qualify for ARC clearance are directed to a fourth bin.

In the foregoing discussion, the documents are described as being physically separated into different bins. Similarly, the images of the documents can be sorted and separated according to the same criteria discussed above. Additionally, in certain applications, it may be desirable to electronically sort the image data for the documents according to the criteria discussed above rather than physically separating the documents as described above. Further still, it may be desirable to sort the physical documents in one manner, while sorting the image data according to different criteria.

Connectivity with Remote Processors

In the previous discussion a number of analyses are described for processing data regarding the documents to make certain determinations. In the present embodiment, the apparatus is configured with a readily connectable interface to allow the operation computer 410 to interconnect with a number of modules designed to make one of the various determinations discussed above, particularly with respect to determinations made based on the scanned images of the documents and the MICR read.

The software architecture for the apparatus utilizes a socket methodology to accomplish interprocess communication with a wide variety of modules designed to determine one or more of the specific analyses discussed above. The socket methodology provides an interface that allows the apparatus to communicate with local or remote systems so that the apparatus can be customized to process the image data and make various determinations based on the user's particular desires.

In this way, the architecture operates under a client/server model. The operation computer 410, operating as a client, sends a request to a server. Referring to the CAR/LAR process for example, a request is made to the CAR/LAR module to analyze the image data for a check. Within a certain period of time, the CAR/LAR module returns a result (check amount, indeterminate or otherwise) to the operation computer. While the CAR/LAR module processes the image data, another request may be made to the CAR/LAR module for a subsequent check. Rather than responding in real time (i.e. before the subsequent response is made), the CAR/LAR module queues the requests and returns the responses in the future, within the predetermined period. When the response is returned, the operation computer associates the response with the relevant documents. A sort decision can then be made if desired, or the operational computer can make the decision later after receiving responses that may have been made for the document or transaction.

By using a socket interface, a number of connections can be made with a variety of servers, local or remote. Each of the servers operate independently to provide the request from the client. The socket interface provides the communication gateway so that each of the remote modules operating as servers, can communicate with the operations computer. If a module is on a remote machine, the socket allows the client and server to communicate between the remote systems. If the module is on a local machine (e.g. the operational computer), the socket allows the client to communicate directly with the module.

In addition, as previously described, the request to the modules may be on a document by document basis or on a transactional basis. For example, in the process of determining the appropriate clearing procedure, the response returned is not simply how to process the piece, the response indicates how the transaction should be processed.

Figure 24:
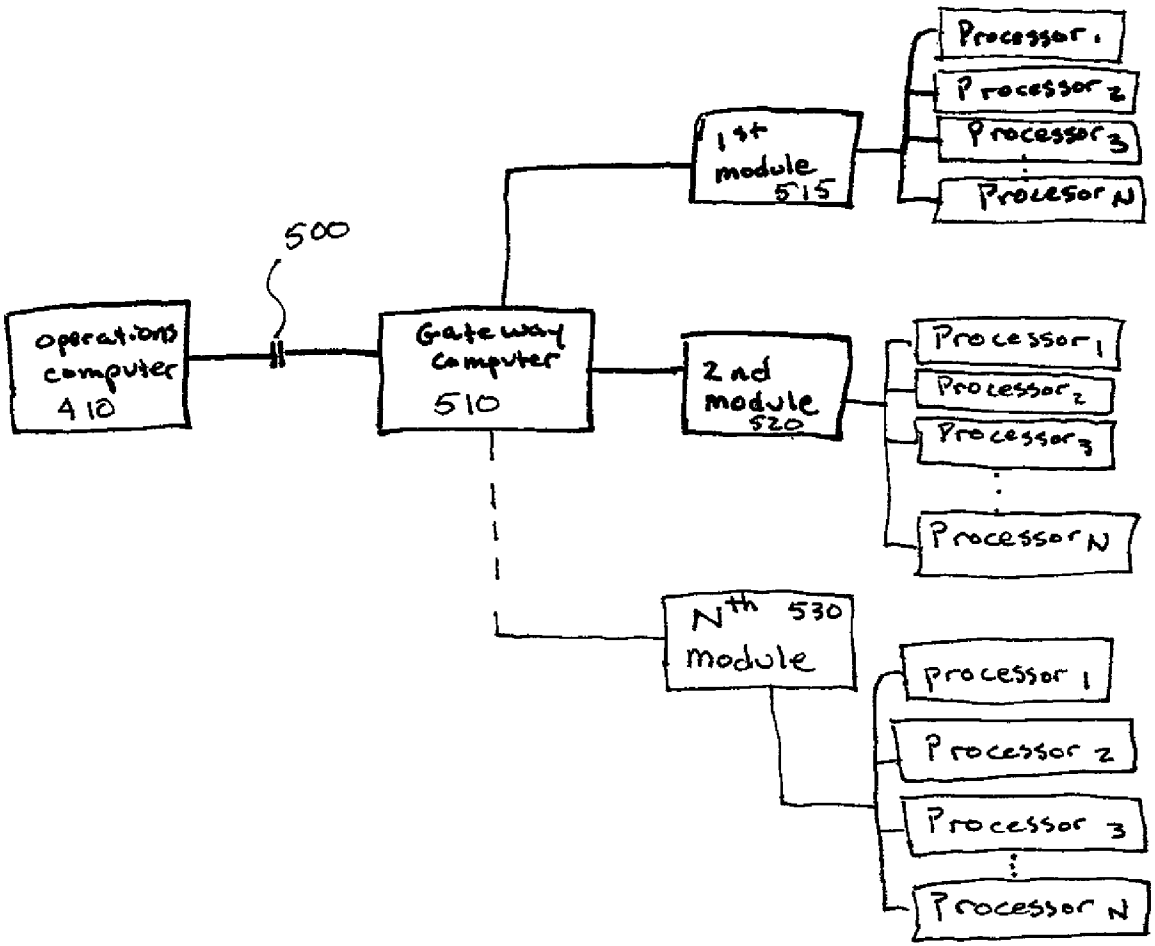
FIG. 24 is a interconnect diagram for the apparatus illustrated in FIG. 1.

Referring now to FIG. 24, an interconnect diagram is provided for the present embodiment. The operations computer 410 is interconnected with a remote gateway computer 510 utilizing a socket 500 interface. The gateway computer receives information for a document or transaction from the operations computer and determines what analyses should be done for the document or transaction. The gateway computer 510 is linked with one or more modules 515, 520, 530, which perform the analyses. The modules in turn may include one or more processors for providing the analyses to be provided. If a module includes a plurality of processors, the processors may be incorporated into a single computer, such as a multiprocessor computer. Alternatively, the module may be interconnected with a plurality of computers.

During operation, the operations computer 410 obtains information for a document. At a certain time after the document is scanned by the image acquisition module 230, the operations computer sends a request to the gateway computer requesting information as to how the document should be processed. Based on the information that the gateway computer receives, the gateway computer determines what analyses are to be performed, and which modules will be utilized to perform the analyses. The gateway computer 510 then communicates with the various modules, sending the relevant document data received from the operations computer 410. After receiving the document data, each module performs one or more analyses using one or more processors. Once the module completes the analysis or analyses for a document, the resulting data is returned to the gateway computer 510, which then communicates the information back to the operations computer 410 via the socket interface 500.

Since the gateway computer 510 is interconnected with a network of modules that may have an array of processors, the analyses for a plurality of documents or transaction may be processed in parallel, as follows. The first document being processed may be a check. The operations computer 410 makes a request from the gateway computer 510 and communicates document data for the first document to the gateway computer. The gateway computer then communicates the information to one or more modules. By way of example, the first module 515 may be a CAR/LAR module having four separate computers operating independently of one another, and the second module 520 may be an image quality module having four separate computers operating independently of one another.

The gateway computer 510 communicates the document data for the first document to the first and second modules 515, 520 and sets a time for responding to the operations computer's request. The first module 515 uses the first of its computers to perform the CAR/LAR analysis for the first document. Similarly, the second module 520 uses the first of its computers its computers to perform the image quality analysis for the first document.

After communicating the first request, and prior to receiving a response back from the gateway computer 510, the operations computer sends a second request for a second document to the gateway computer. If the second document is also a check and a CAR/LAR and an image quality analysis are appropriate, the gateway computer sends a request to the first and second modules and communicates the relevant data for the second document. The first module then performs the CAR/LAR analysis for the second document using its second computer. In this way the second computer of the CAR/LAR module performs the CAR/LAR analysis for the second document independent of the analysis being performed for the first document by the first computer of the CAR/LAR module. Similarly, the gateway computer 510 sends a request to the second module and communicates the data for the second document. The second module then performs the image quality analysis for the second document using its second computer.

The process described above continues with the operations computer continuing to send requests and document data to the gateway computer, which communicates the data with the various modules. Each module queues the requests and responds the data from the analysis of a particular document as soon as the analysis is complete. In this way, a module may return the data from the analysis for the second document before the analysis for the first document is completed.

After the gateway computer 510 receives the responses back from each of the relevant modules used for a request from the operations computer, the gateway communicates the data back to the operations computer, so that a determination is made regarding how the document is to be processed down stream. Since the modules 515, 520, 530 are able to queue and independently process in parallel requests for a plurality of document, a greater number of analyses can be completed for a document than may otherwise be possible if the analyses were processed in real time.

As discussed previously, in the present embodiment, the configuration of the upper section 100 provides a time window of approximately 500 milliseconds to perform various analyses before a sort determination needs to be made for a document. In addition, at a transport rate of approximately 150 to 160 inches/sec, the pieces are processed approximately 100 milliseconds apart. Therefore, during the 500 millisecond time window mentioned above, the gateway computer and associated modules may queue and process multiple outstanding requests for a plurality of pieces. In other words, during the 500 millisecond period available for completing the analysis for a particular document, the gateway computer and associated modules perform parallel analyses for a plurality of documents.

Configured as discussed above, the operations computer communicates the document information to the gateway computer, which in turn sets a time frame for communicating a response to the operations computer. If a response from a module is not received for a document within the time frame, at the end of the time frame, the gateway computer determines that the analysis from the module could not be determined, and indicates such in the response to the operations computer.

It will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. An apparatus for processing mail, comprising:

a feeder for serially feeding envelopes from a stack of envelopes containing contents to a first envelope transport;

an envelope qualification section for determining whether an envelope is qualified for further processing;

a buffer feeder configured to receive and stack a plurality of envelopes from the envelope qualification section, wherein the buffer feeder is operable to serially feed envelopes from the stack of envelopes in the buffer feeder to a second envelope transport;

a sensor operable to detect whether the thickness of the stack of envelopes in the buffer feeder is below a threshold;

a controller for controlling the operation of the feeder or the first transport in response to the whether the detected thickness of the stack of envelopes is below the threshold to increase or decrease the rate at which envelopes are delivered by the first envelope transport from the feeder to the buffer feeder; and an extractor operable to receive envelopes from the buffer feeder and extract the contents from the envelopes;

wherein envelopes that are not qualified for further processing by the envelope qualification section are outsorted between the envelope section and the extractor thereby creating gaps in the flow of envelopes and wherein the controller and buffer are operable to reduce the gaps.

2. The apparatus of claim 1 wherein at least substantially all of the envelopes qualified for further processing by the qualification section are conveyed to the buffer feeder.

3. The apparatus of claim 1 wherein the buffer feeder comprises a retard for engaging envelopes to impede feeding a pair of envelopes at one time.

4. The apparatus of claim 1 wherein the buffer feeder comprises an advancement mechanism configured to advance envelopes entering the buffer feeder toward the stack without nipping the envelopes.

5. The apparatus of claim 4 wherein the buffer feeder comprises an accumulation area for receiving envelopes from the advancement mechanism, wherein the accumulation area is configured to form a stack of envelopes from the envelopes advanced by the advancement mechanism.

6. The apparatus of claim 1 wherein the buffer feeder is disposed in an envelope path extending from the qualification station to the extractor.

7. The apparatus of claim 6 wherein the buffer feeder has an input in the envelope path for receiving envelopes from the qualification section and an output in the envelope path for feeding envelopes to the extractor.

8. The apparatus of claim 6 wherein substantially all of the envelopes received by the extractor pass through the qualification station and the buffer feeder.

9. The apparatus of claim 1 wherein the first envelope transport conveys envelopes at a higher rate of speed then the second envelope transport.

10. An apparatus for processing mail, comprising:

a feed station comprising a feeder for serially feeding envelopes from a stack of envelopes and a first envelope transport for receiving the envelopes from the feeder;

an envelope qualification section for receiving envelopes from the feed station and determining whether an envelope is qualified for further processing;

a buffer feeder configured to receive and stack a plurality of envelopes from the envelope qualification section, wherein the buffer feeder is operable to serially feed envelopes from the stack of envelopes in the buffer feeder to a second envelope transport;

a thickness detector for detecting whether the thickness of the stack of envelopes in the buffer feeder is above a predetermined thickness;

a controller for controlling the operation of the feed station to increase the rate that the feed station feeds envelopes to the envelope qualification station if the thickness detector detects a stack thickness below the predetermined thickness; and an extractor operable to receive envelopes from the second envelope transport and extract the contents from the envelopes;

wherein if the envelope qualification station determines that an envelope does not qualify for further processing, the envelope is outsorted before being conveyed to the extractor, thereby creating a gap in the flow of envelopes, wherein the controller and the buffer feeder operate to reduce the gap in the flow of envelopes transported to the extractor.

11. The apparatus of claim 10 wherein at least substantially all of the envelopes qualified for further processing by the qualification section are conveyed to the buffer feeder.

12. The apparatus of claim 10 wherein the buffer feeder comprises a retard for engaging envelopes to impede feeding a pair of envelopes at one time.

13. The apparatus of claim 10 wherein the buffer feeder comprises an advancement mechanism configured to advance envelopes entering the buffer feeder toward the stack without nipping the envelopes.

14. The apparatus of claim 13 wherein the buffer feeder comprises an accumulation area for receiving envelopes from the advancement mechanism, wherein the accumulation area is configured to form a stack of envelopes from the envelopes advanced by the advancement mechanism.

15. The apparatus of claim 10 wherein the buffer feeder is disposed in an envelope path extending from the qualification station to the extractor.

16. The apparatus of claim 15 wherein the buffer feeder has an input in the envelope path for receiving envelopes from the qualification section and an output in the envelope path for feeding envelopes to the extractor.

17. The apparatus of claim 15 wherein substantially all of the envelopes received by the extractor pass through the qualification station and the buffer feeder.

18. The apparatus of claim 10 wherein the first envelope transport conveys envelopes at a higher rate of speed then the second envelope transport.

19. The apparatus of claim 10 wherein the envelope qualification station comprises a thickness detector for detecting the thickness of an envelope and the controller is operable to direct the envelope to an outsort area rather than the buffer feeder if the envelope thickness detector detects a thickness that is outside a predetermined thickness range.

20. A method for processing mail, comprising:

serially feeding envelopes from a stack of envelopes to a first envelope transport;

determining whether an envelope is qualified for further processing;

outsorting the envelope is the envelope is not qualified for further processing, wherein the step of outsorting creates a gap in the flow of envelopes;

stacking a plurality of qualified envelopes in a buffer;

detecting the thickness of the stack of qualified envelopes in the buffer;

controlling the rate of feeding envelopes to the buffer in response to the thickness of the stack of envelopes in the buffer;

serially feeding envelopes from the stack of envelopes in the buffer to a second envelope transport, wherein the step of controlling the rate of feeding and serially feeding envelopes from the buffer reduces the gap in the flow of envelopes;

receiving envelopes from the second envelope transport and extract the contents from the envelopes.

21. The method of claim 20 comprising the steps of controlling the speed of the first envelope transport so that the first envelope transport operates at a higher rate of speed than the second envelope transport.

22. The method of claim 20 wherein the step of controlling the rate of feeding envelopes to the buffer comprises increasing the rate of speed of the first envelope transport in response to detecting a thickness below a threshold.

23. The method of claim 20 wherein the step of controlling the rate of feeding envelopes to the buffer comprises decreasing the rate of speed of the first envelope transport in response to detecting a thickness above a threshold.

24. The method of claim 20 wherein the step of determining whether an envelope is qualified for further processing comprises detecting the thickness of the envelope.

25. The method of claim 24 comprising the step of directing the envelope to an outsort area if the detected thickness is above a predetermined thickness.

26. The apparatus of claim 1 wherein the controller and buffer are operable to reduce the gaps by controlling the operation of the feeder or the first envelope transport in response to a signal from the sensor regarding the detected thickness.

* * * * *